US008785089B2

(12) United States Patent
Okuda et al.

(10) Patent No.: US 8,785,089 B2
(45) Date of Patent: Jul. 22, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Atsushi Okuda, Yokohama (JP); Tsutomu Nishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 13/514,146

(22) PCT Filed: Dec. 2, 2010

(86) PCT No.: PCT/JP2010/072069

§ 371 (c)(1),
(2), (4) Date: Jun. 6, 2012

(87) PCT Pub. No.: WO2011/071093

PCT Pub. Date: Jun. 16, 2011

(65) Prior Publication Data

US 2012/0243904 A1 Sep. 27, 2012

(30) Foreign Application Priority Data

Dec. 9, 2009 (JP) ..... 2009-279920
Dec. 9, 2009 (JP) ..... 2009-279920
Nov. 9, 2010 (JP) ..... 2010-241153

(51) Int. Cl.
*G03G 15/04* (2006.01)
*G03G 5/00* (2006.01)

(52) U.S. Cl.
USPC ..... 430/58.2; 430/58.3; 430/70; 430/96; 399/111; 399/96

(58) Field of Classification Search
USPC ..... 430/58.2, 58.3, 70, 96; 399/111, 159
See application file for complete search history.

(56) References Cited

FOREIGN PATENT DOCUMENTS

| | | | |
|---|---|---|---|
| CN | 1326118 | A | 12/2001 |
| CN | 1748184 | A | 3/2006 |
| JP | 5-158249 | A | 6/1993 |
| JP | 07-261442 | A | 10/1995 |
| JP | 7-261442 | A | 10/1995 |
| JP | 2005-242373 | A | 9/2005 |
| JP | 2007-004133 | A | 1/2007 |
| JP | 2007-79555 | A | 3/2007 |
| JP | 2008-195905 | A | 8/2008 |
| JP | 2009-037229 | A | 2/2009 |
| WO | 2008/013186 | A | 1/2008 |

*Primary Examiner* — Thorl Chea
(74) *Attorney, Agent, or Firm* — Canon U.S.A., Inc., IP Division

(57) ABSTRACT

The present invention provides an electrophotographic photosensitive member, and a process cartridge and an electrophotographic apparatus, each of which has the electrophotographic photosensitive member. In the electrophotographic photosensitive member, a charge transport layer used as a surface layer contains a charge transport material, a polycarbonate resin A which has a specific amount of a specific repeating structural unit of a specific siloxane moiety, and a polyester resin C and/or a polycarbonate resin D, each of which has a specific repeating structural unit. In the charge transport layer, a matrix-domain structure is formed in which a matrix is formed from the charge transport material and the polyester resin C and/or the polycarbonate resin D, and domains are formed in the above matrix from the polycarbonate resin A.

5 Claims, 1 Drawing Sheet

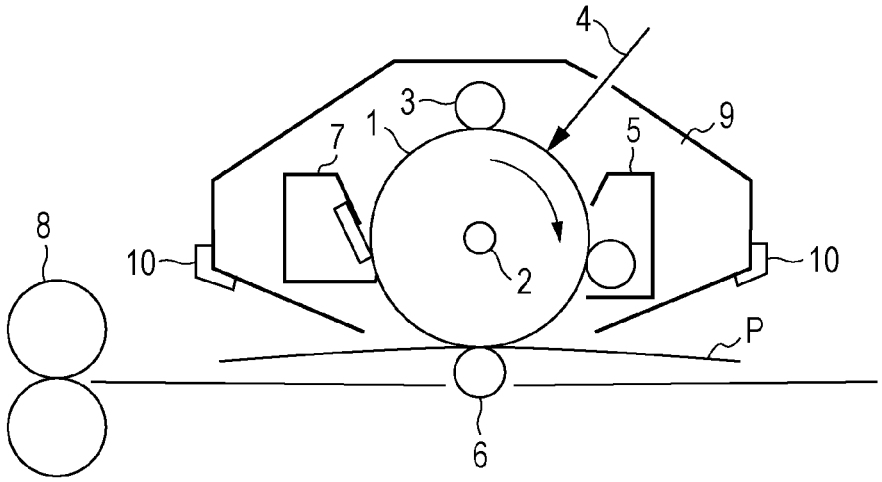
4
3
1
7
5
9
8
10
2
10
P
6

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, and a process cartridge and an electrophotographic apparatus, each including the electrophotographic photosensitive member.

BACKGROUND ART

As a photoconductive material (a charge generation material or a charge transport material) used for an electrophotographic photosensitive member mounted to an electrophotographic apparatus, an organic photoconductive material has been actively developed. An electrophotographic photosensitive member using an organic photoconductive material generally has a photosensitive layer formed by applying a coating liquid in which an organic photoconductive material and a resin (binding resin) are dissolved or dispersed in a solvent on a support, followed by drying. In addition, the photosensitive layer generally has a lamination type (regular lamination type) structure in which a charge generation layer and a charge transport layer are laminated in this order from a support side.

However, the electrophotographic photosensitive member using an organic photoconductive material has not all the properties required as the electrophotographic photosensitive member. In an electrophotographic process, various materials (hereinafter referred to as "contact members and the like" in some cases) such as a developing powder, a charging member, a cleaning blade, a paper sheet, and a transfer member, are brought into contact with the surface of the electrophotographic photosensitive member. As one of the properties required for the electrophotographic photosensitive member, reduction of degradation in image caused by contact stress with the contact members and the like may be mentioned. In particular, in recent years, as the durability of the electrophotographic photosensitive member has been improved, the continuousness of an effect of reducing degradation in image caused by the above contact stress has been desired.

In order to reduce the above contact stress, a proposal has been made in which a siloxane modified resin having a siloxane structure in its molecular chain is contained in a surface layer of an electrophotographic photosensitive member which is brought into contact with the above various contact members. For example, PTL 1 has disclosed a resin in which a siloxane structure is incorporated in a polycarbonate resin. In addition, PTL 2 has disclosed a technique in which domains are formed in an electrophotographic photosensitive member using a block copolymer resin material having a siloxane structure. As in the above techniques, PTL 3 has also disclosed a technique in which a silicone material in the form of particles is dispersed in a charge transport layer of an electrophotographic photosensitive member, and according to this patent literature, it has been reported that discharge breakdown can be effectively prevented and image degradation (generation of black marks) can be suppressed. In PTL 4 and PTL 5, a polycarbonate resin having a siloxane structure in its side chain has been disclosed.

However, by the electrophotographic photosensitive members disclosed in the above patent literatures, the maintenance of the electrophotographic properties and the continuous reduction of contact stress cannot be simultaneously achieved. In PTL 1, since a polycarbonate resin incorporating a siloxane structure and a polyarylate resin are contained, initial sliding properties are obtained. Although the continuousness of sliding properties is also improved, the degree of the improvement is not satisfactory. In addition, in PTL 1, as a method for imparting continuous sliding properties, a surface layer in which resins are mixed together has been proposed. However, PTL 1 has disclosed that domain formation by resin mixing decreases the optical transmittance and the sensitivity and that the content of a siloxane is controlled so as not to cause the domain formation. In addition, when the content of a siloxane moiety of the polycarbonate resin having a siloxane structure disclosed in PTL 1 was increased, agglomerate of a charge transport material is formed in a polyarylate resin, and as a result, potential stability in a repeated use was degraded in some cases.

The material disclosed in PTL 2 is a resin which includes a component having low surface energy properties and a matrix component, these two components being included in the same resin, and this patent literature has disclosed that since the component having low surface energy properties forms domains, a low surface energy state is formed. Since a siloxane moiety having low surface energy properties has a high surface migration property (interface migration property) and is liable to exist at an interface with a charge generation layer which is adjacent to a charge transport layer, in an electrophotographic photosensitive member comprising a photosensitive layer having a lamination type structure, an increase in potential variation may occur thereby in some cases. In the electrophotographic photosensitive member formed from the material disclosed in PTL 2, the potential variation caused by the above reason also occurred in some cases.

Also in the electrophotographic photosensitive member disclosed in PTL 3 in which the silicone material in the form of particles is dispersed in the charge transport layer, by the surface migration property (interface migration property) as that described above, the potential variation occurred in some cases by the above reason.

In addition, in the case in which when the polycarbonate resin having a siloxane structure in its side chain disclosed in PTL 4 was used for an electrophotographic photosensitive member, a charge transport material was agglomerated in the polycarbonate resin, and the potential stability in a repeated use was degraded in some cases. In PTL 4, in order not to degrade the transparency and the electrical properties, reduction of a siloxane content was investigated; however, the formation of a matrix-domain structure with another resin has not been disclosed. In addition, in PTL 4, impartment of the sliding properties to the electrophotographic photosensitive member has been disclosed, and the initial sliding properties were improved; however, the continuation of the sliding properties in a repeated use was not always satisfactory. In PTL 5, in order not to degrade the heat resistance, reduction of a siloxane content was investigated; however, the formation of a matrix-domain structure with another resin has not been disclosed. In addition, in PTL 5, impartment of the sliding properties to the electrophotographic photosensitive member has been disclosed, and the initial sliding properties were improved; however, the continuation of the sliding properties in a repeated use was not always satisfactory.

CITATION LIST

Patent Literature

PTL 1 Japanese Patent Laid-Open No. 2009-037229
PTL 2 Japanese Patent Laid-Open No. 2007-004133

PTL 3 Japanese Patent Laid-Open No. 2005-242373
PTL 4 Japanese Patent Laid-Open No. 5-158249
PTL 5 Japanese Patent Laid-Open No. 2008-195905

SUMMARY OF INVENTION

The present invention provides an electrophotographic photosensitive member which is capable of continuously maintaining an effect of reducing contact stresses generated by contact with contact members and the like and which is excellent in potential stability in a repeated use, and a process cartridge and an electrophotographic apparatus, each of which has the above electrophotographic photosensitive member.

The present invention provides an electrophotographic photosensitive member which comprises: a support; a charge generation layer provided on the support; and a charge transport layer which is provided on the charge generation layer, which contains a charge transport material and resins, and which is a surface layer. In the electrophotographic photosensitive member described above, the charge transport layer contains the charge transport material, a polycarbonate resin A having a repeating structural unit represented by the following formula (1) or (101), a repeating structural unit represented by the following formula (2), and a repeating structural unit represented by the following formula (3), and at least one of a polyester resin C having a repeating structural unit represented by the following structural unit (C) and a polycarbonate resin D having a repeating structural unit represented by the following formula (D), the content of a siloxane moiety in the polycarbonate resin A is 10 to 40 percent by mass to the total mass of the polycarbonate resin A, the content of the repeating structural unit represented by the following formula (2) in the polycarbonate resin A is 5 to 50 percent by mass to the total mass of the polycarbonate resin A, and the charge transport layer has a matrix-domain structure including a matrix formed from the charge transport material and at least one of the polyester resin C and the polycarbonate resin D and domains formed in the matrix from the polycarbonate resin A.

[Chem. 1]

(1)

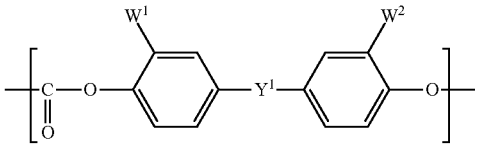

In the formula (1), $Y^1$ represents a single bond or a substituted or an unsubstituted alkylene group. $W^1$ and $W^2$ independently represent a monovalent group represented by the following formula (a) or (b).

[Chem. 2]

(a)

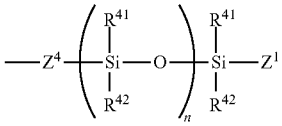

-continued (b)

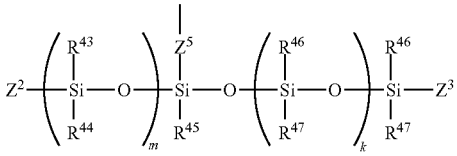

In the formulas (a) and (b), $Z^1$ to $Z^3$ independently represent a substituted or an unsubstituted alkyl group having 1 to 4 carbon atoms. $Z^4$ and $Z^5$ independently represent a substituted or an unsubstituted alkylene group having 1 to 4 carbon atoms. $R^{41}$ to $R^{47}$ independently represent a substituted or an unsubstituted alkyl group or a substituted or an unsubstituted aryl group. In addition, n, m, and k independently represent the average repeat number of the structure in the parentheses, n is 10 to 150, and m+k is 10 to 150.

[Chem. 3]

(101)

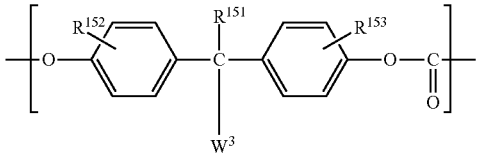

In the formula (101), $R^{151}$ to $R^{153}$ independently represent a hydrogen atom, a substituted or an unsubstituted alkyl group, or a substituted or an unsubstituted aryl group. $W^3$ represents a monovalent group represented by the following formula (e) or (f).

[Chem. 4]

(e)

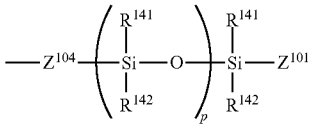

(f)

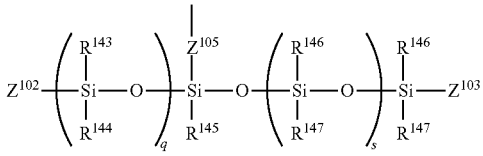

In the formulas (e) and (f), $Z^{101}$ to $Z^{103}$ independently represent a substituted or an unsubstituted alkyl group having 1 to 4 carbon atoms. $Z^{104}$ and $Z^{105}$ independently represent a substituted or an unsubstituted alkylene group having 1 to 20 carbon atoms. $R^{141}$ to $R^{147}$ independently represent a substituted or an unsubstituted alkyl group or a substituted or an unsubstituted aryl group. In addition, p, q, and s independently represent the average repeat number of the structure in the parentheses, p is 10 to 150, and q+s is 10 to 150.

[Chem. 5]

(2)

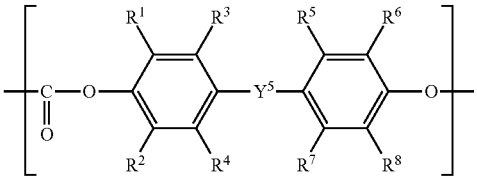

In the formula (2), $R^1$ to $R^8$ independently represent a hydrogen atom or a substituted or an unsubstituted alkyl group. $Y^5$ represents an oxygen atom or a sulfur atom.

[Chem. 6]

(3)

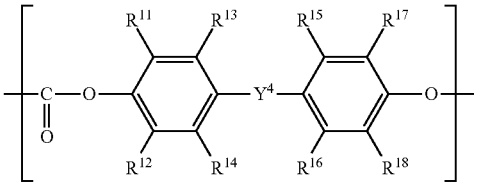

In the formula (3), $R^{11}$ to $R^{18}$ independently represent a hydrogen atom or a substituted or an unsubstituted alkyl group. $Y^4$ represents a single bond or a substituted or an unsubstituted alkylene group.

[Chem. 7]

(C)

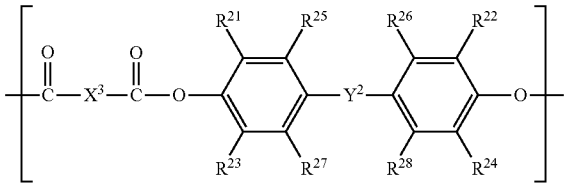

In the formula (C), $R^{21}$ to $R^{28}$ independently represent a hydrogen atom or a substituted or an unsubstituted alkyl group. $X^3$ represents a substituted or an unsubstituted alkylene group, a substituted or an unsubstituted arylene group, a substituted or an unsubstituted biphenylene group, or a divalent group in which at least two phenylene groups are bonded to each other with an alkylene group or an oxygen atom interposed therebetween. $Y^2$ represents a single bond or a substituted or an unsubstituted alkylene group.

[Chem. 8]

(D)

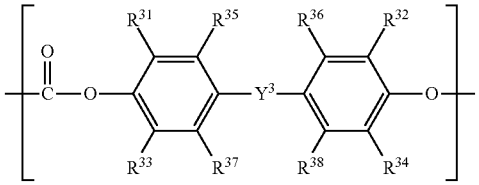

In the formula (D), $R^{31}$ to $R^{38}$ independently represent a hydrogen atom or a substituted or an unsubstituted alkyl group. $Y^3$ represents a single bond or a substituted or an unsubstituted alkylene group.

In addition, the present invention provides a process cartridge which includes the above electrophotographic photosensitive member and at least one unit selected from the group consisting of a charging unit, a developing unit, a transfer unit, and a cleaning unit, and the electrophotographic photosensitive member and the at least one unit are integrally supported and are detachably mountable to a main body of an electrophotographic apparatus.

Furthermore, the present invention provides an electrophotographic apparatus which includes the above electrophotographic photosensitive member, a charging unit, an exposure unit, a developing unit, and a transfer unit.

According to the present invention, there are provided an electrophotographic photosensitive member which can continuously maintain an effect of reducing contact stress generated by contact members and the like and which has excellent potential stability in a repeated use, and a process cartridge and an electrophotographic apparatus, each of which has the electrophotographic photosensitive member.

BRIEF DESCRIPTION OF DRAWING

The FIGURE is a view illustrating one example of a schematic structure of an electrophotographic apparatus including a process cartridge which has an electrophotographic photosensitive member of the present invention.

DESCRIPTION OF EMBODIMENTS

In the formula (1), $W^1$ and $W^2$ independently represent a monovalent group represented by the above formula (a) or (b).

In the above formulas (a) and (b), $Z^1$ to $Z^3$ independently represent a substituted or unsubstituted alkyl group having 1 to 4 carbon atoms. As the alkyl group having 1 to 4 carbon atoms, there is mentioned a methyl group, an ethyl group, a propyl group, or a butyl group. Among these mentioned above, in view of compatibility (the degree of difficulty in phase separation; hereinafter, the compatibility has the same meaning as described above) between a polycarbonate resin A and a charge transport material, a butyl group is preferable. As the substituent, for example, an alkyl group, such as a methyl group, an ethyl group, a propyl group, or a butyl group, or an aryl group, such as a phenyl group, may be mentioned.

In the above formula (a) and (b), $Z^4$ and $Z^5$ independently represent a substituted or an unsubstituted alkylene group having 1 to 4 carbon atoms. As the alkylene group having 1 to 4 carbon atoms, there is mentioned a methylene group, an ethylene group, a propylene group, or a butylene group. Among these mentioned above, in view of the compatibility between the polycarbonate resin A and the charge transport material, a propylene group is preferable. As the substituent, for example, an alkyl group, such as a methyl group, an ethyl group, a propyl group, or a butyl group, or an aryl group, such as a phenyl group, may be mentioned.

In the above formula (a) and (b), $R^{41}$ to $R^{47}$ independently represent a substituted or an unsubstituted alkyl group or a substituted or an unsubstituted aryl group. As the alkyl group, for example, a methyl group or an ethyl group may be mentioned. As the aryl group, for example, a phenyl group may be mentioned. Among these mentioned above, in view of reduction of the contact stress, $R^{41}$ to $R^{47}$ each preferably represent a methyl group.

In the above formulas (a) and (b), n, m, and k independently represent the average repeat number of the structure (—Si—O—) in the parentheses, n is 10 to 150, and m+k is 10 to 150. When n and m+k are each 10 to 150, domains formed from the polycarbonate resin A are efficiently formed in a matrix formed from the charge transport material and at least one of a polyester resin C and a polycarbonate resin D. In particular, n and m+k are each preferably 20 to 100.

In the above formula (1), $Y^1$ represents a single bond or a saturated or an unsaturated an alkylene group. As the alkylene group, a methylene group, an ethylene group, a propylene group, or a butylene group is preferable, and among these mentioned above, in view of mechanical strength, a methylene group is preferable. As the substituent, for example, an alkyl group, such as a methyl group, an ethyl group, a propyl group, or a butyl group, or an aryl group, such as a phenyl group, may be mentioned. Among these mentioned above, a methyl group is preferable. In addition, $Y^1$ may represent a group having a ring structure formed by bonding between substituents. As the group having a ring structure formed by bonding between substituents, for example, a cycloalkylidene group, such as a cyclopentylidene group, a cyclohexylidene group, or a cycloheptylidene group, may be mentioned. Among these mentioned above, a cyclohexylidene group is preferable.

Hereinafter, particular examples of the repeating structural unit represented by the above formula (1) will be shown.

[Chem. 9]

(1-1)

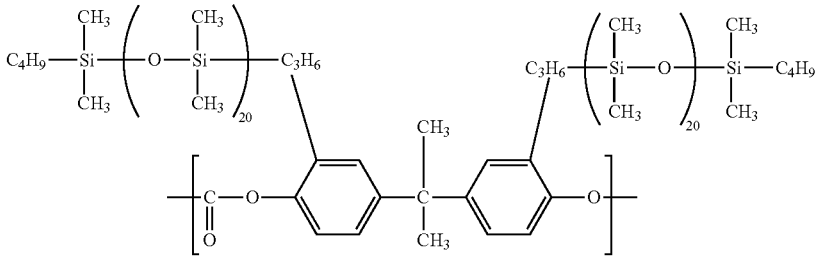

(1-2)

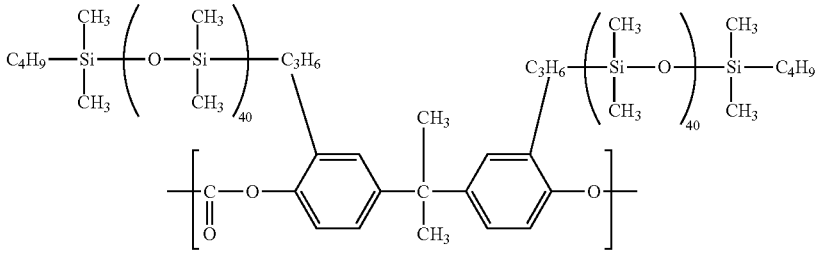

(1-3)

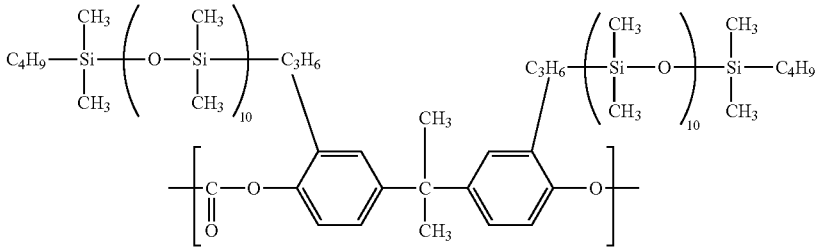

(1-4)

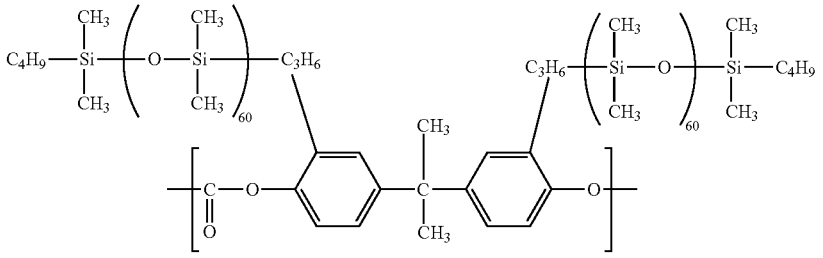

-continued
(1-5)
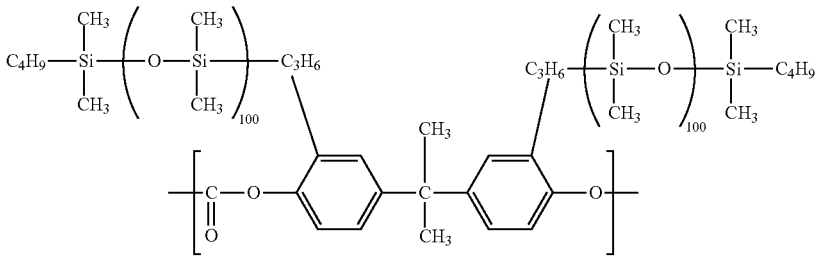
(1-6)
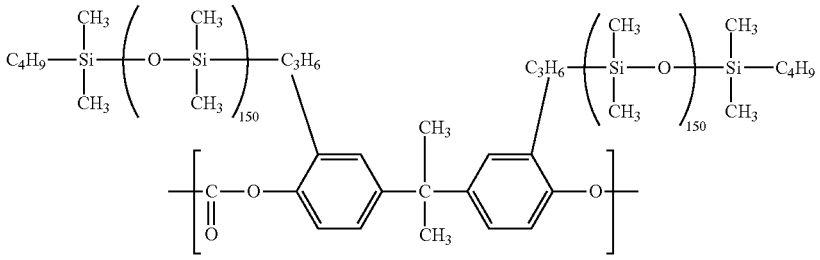
(1-7)
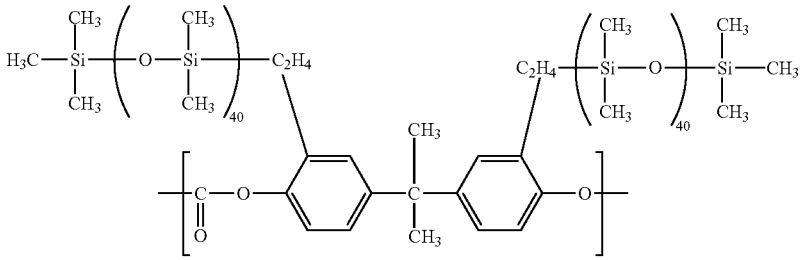
(1-8)
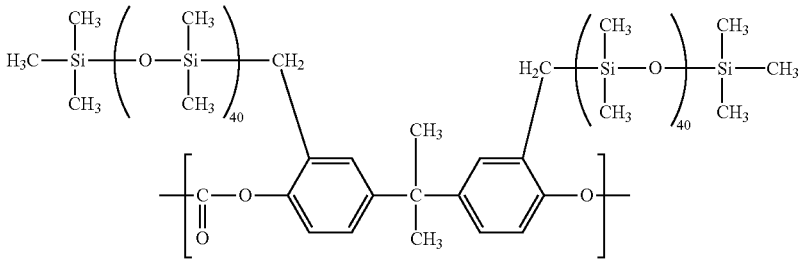
(1-9)
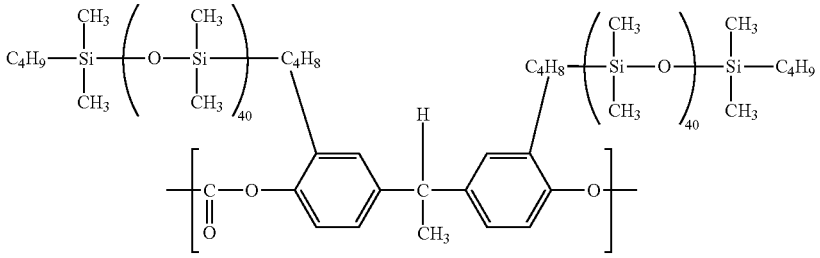
(1-10)
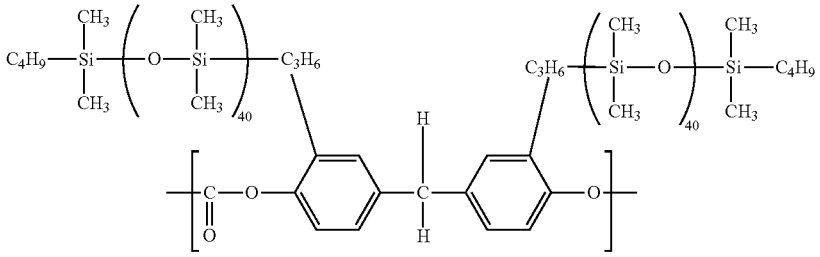

-continued
(1-11)
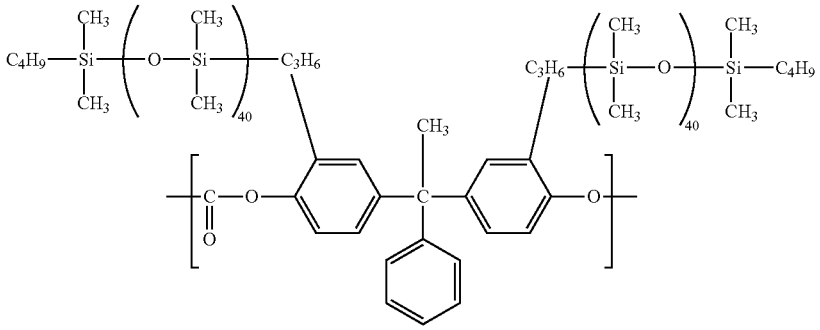
(1-12)
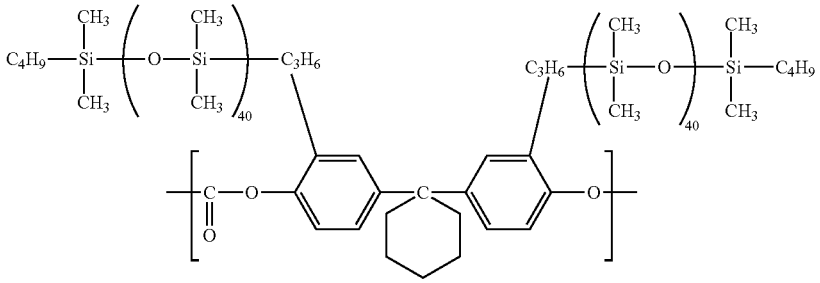
(1-13)
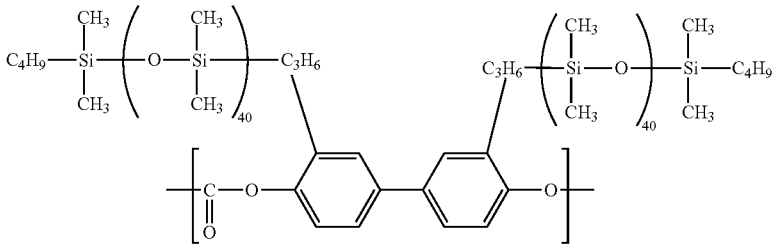
(1-14)
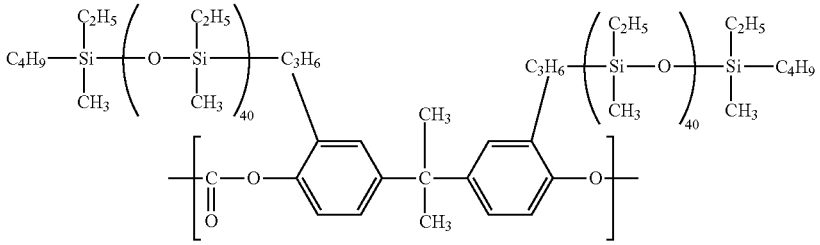
(1-15)
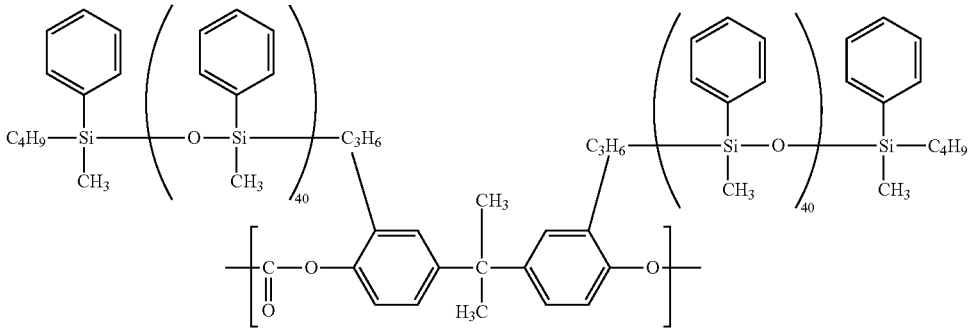

-continued (1-16)

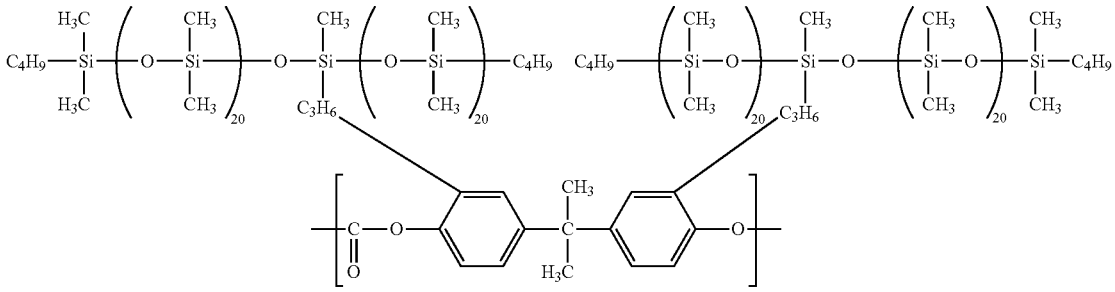

Among these examples, the repeating structural units represented by the above formulas (1-1), (1-2), (1-3), and (1-4) are preferable.

In the above formula (101), $R^{151}$ to $R^{153}$ independently represent a hydrogen atom, a saturated or an unsaturated alkyl group, or a saturated or an unsaturated aryl group. As the alkyl group, for example, a methyl group or an ethyl group may be mentioned. As the aryl group, for example, a phenyl group may be mentioned. Among these mentioned above, a methyl group is preferable in terms of reduction of the contact stress.

In the above formula (101), $W^3$ represents a monovalent group represented by the above formula (e) or (f).

In the above formulas (e) and (f), $Z^{101}$ to $Z^{103}$ independently represent a saturated or an unsaturated alkyl group having 1 to 4 carbon atoms. As the alkyl group having 1 to 4 carbon atoms, a methyl group, an ethyl group, a propyl group, or a butyl group is mentioned. Among these mentioned above, a butyl group is preferable in view of the compatibility between the polycarbonate resin A and the charge transport material. As the substituent, for example, an alkyl group, such as a methyl group, an ethyl group, a propyl group, or a butyl group, or an aryl group, such as a phenyl group, may be mentioned.

In the above formula (e) and (f), $Z^{104}$ and $Z^{105}$ independently represent a saturated or an unsaturated alkylene group having 1 to 20 carbon atoms. As the alkylene group having 1 to 20 carbon atoms, for example, there may be mentioned a methylene group, an ethylene group, a propylene group, a butylene group, a pentylene group, a hexylene group, a heptylene group, an octylene group, a nonylene group, a decylene group, an undecylene group, or a dodecylene group. Among these mentioned above, a decylene group is preferable since it forms the domains. As the substituent, for example, an alkyl group, such as a methyl group, an ethyl group, a propyl group, or a butyl group, or an aryl group, such as a phenyl group, may be mentioned.

In the above formula (e) and (f), $R^{141}$ to $R^{147}$ independently represent a saturated or an unsaturated alkyl group or a saturated or an unsaturated aryl group. As the alkyl group, for example, a methyl group or an ethyl group may be mentioned. As the aryl group, for example, a phenyl group may be mentioned. Among these mentioned above, $R^{141}$ to $R^{147}$ preferably represent a methyl group in terms of reduction of the contact stress.

In the above formula (e) and (f), p, q, and s independently represent the average repeat number of the structure (—Si—O—) in the parentheses, p is 10 to 150, and q+s is 10 to 150. When p and q+s are each 10 to 150, the domains formed from the polycarbonate resin A is efficiently formed in the matrix formed from the charge transport material and at least one of the polyester resin C and the polycarbonate resin D. In particular, p and q+s are each preferably 20 to 100.

Hereinafter, particular examples of the repeating structural unit represented by the above formula (101) will be shown.

[Chem. 10]

(101-1)

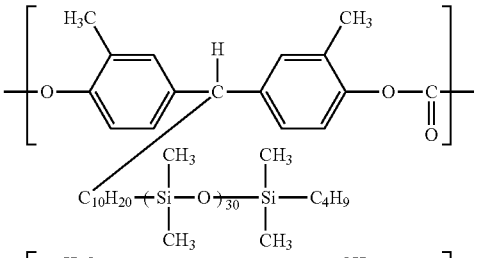

(101-2)

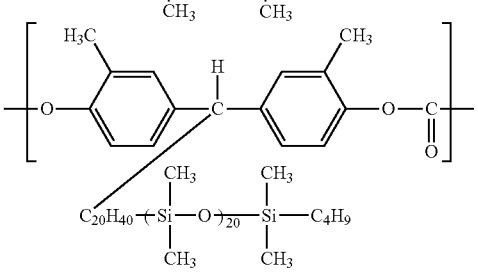

(101-3)

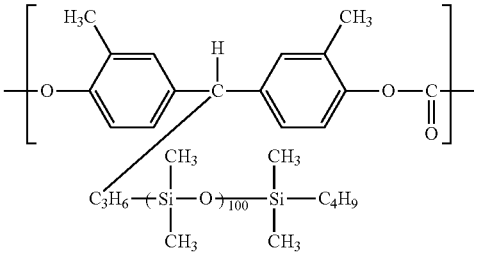

(101-4)

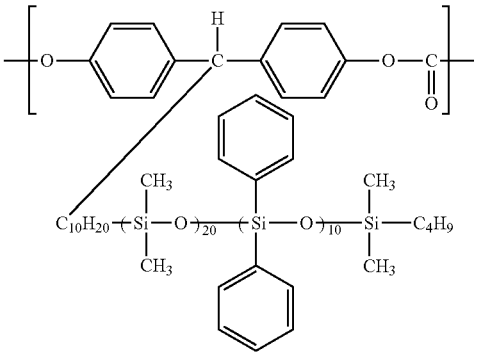

-continued
(101-5)
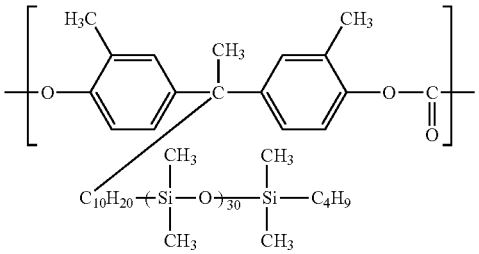
(101-6)
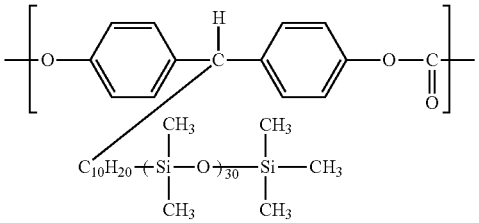
(101-7)
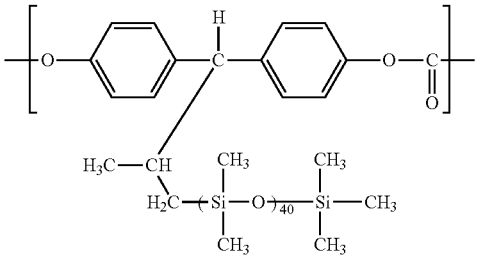
(101-8)
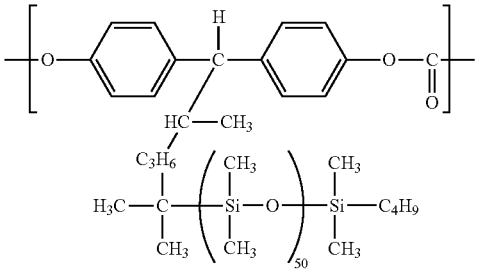
(101-9)
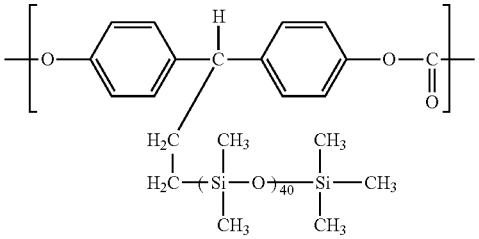
(101-10)
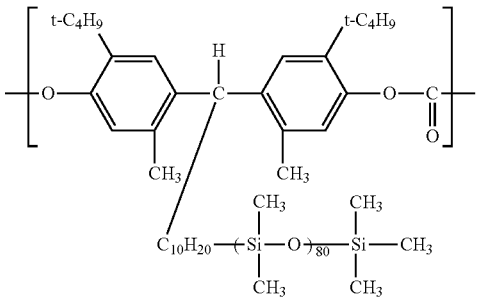
-continued
(101-11)
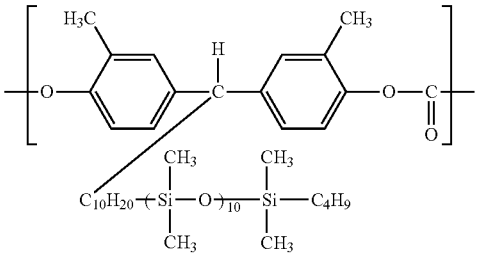
(101-12)
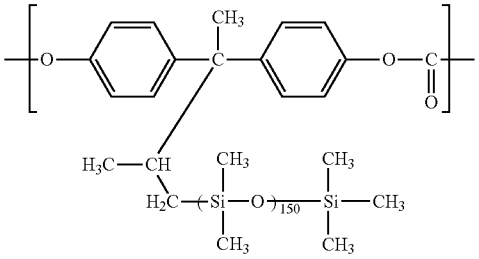
(101-13)
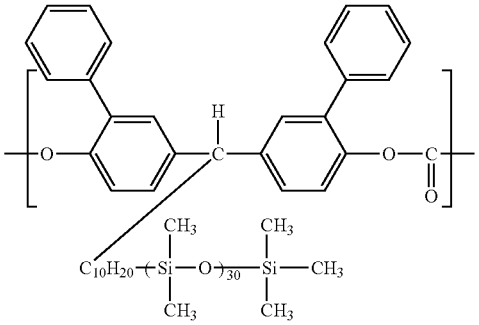
(101-14)
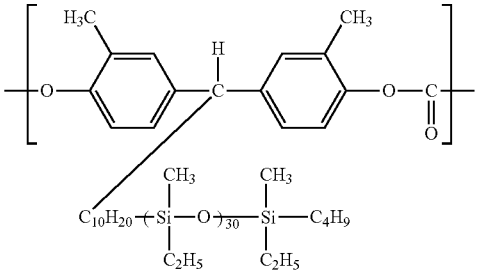
(101-15)
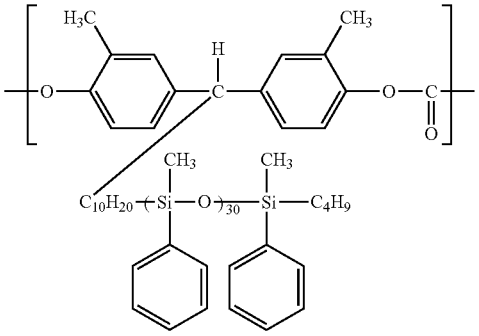

-continued (101-16)

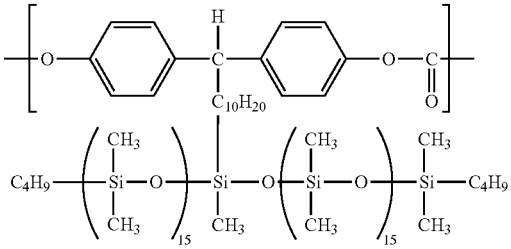

Among these examples, the repeating structural units represented by the above formulas (101-1), (101-2), and (101-3) are preferable.

In the above formula (2), $R^1$ to $R^8$ independently represent a hydrogen atom or a saturated or an unsaturated alkyl group. As the alkyl group, for example, a methyl group, an ethyl group, a propyl group, or a butyl group, may be mentioned. Among these mentioned above, a hydrogen atom or a methyl group is preferable. As the substituent, for example, an alkyl group, such as a methyl group, an ethyl group, a propyl group, or a butyl group, or an aryl group, such as a phenyl group, may be mentioned.

Hereinafter, particular examples of the repeating structural unit represented by the above formula (2) will be shown.

[Chem. 11]

(2-1)

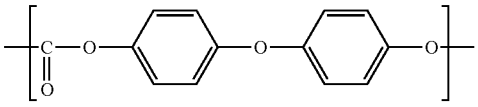

(2-2)

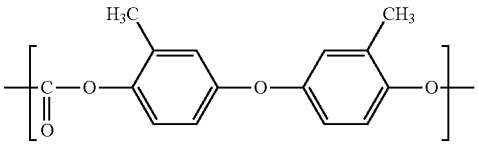

(2-3)

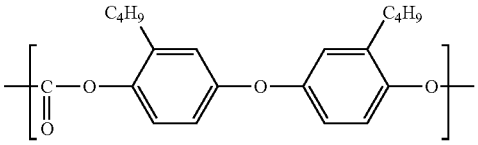

(2-4)

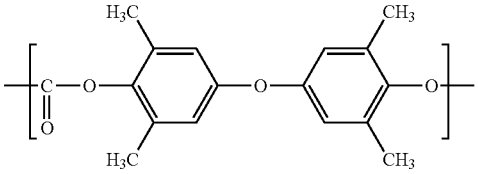

(2-5)

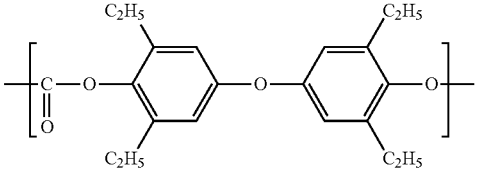

-continued (2-6)

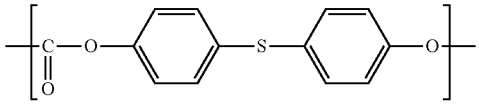

(2-7)

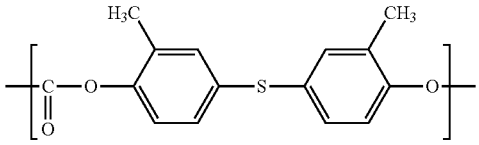

Among these examples, the repeating structural units represented by the above formulas (2-1) and (2-2) are preferable.

In the above formula (3), $R^{11}$ to $R^{18}$ independently represent a hydrogen atom or a saturated or an unsaturated alkyl group. As the alkyl group, for example, a methyl group, an ethyl group, a propyl group, or a butyl group may be mentioned. Among these mentioned above, a methyl group is preferable. As the substituent, for example, an alkyl group, such as a methyl group, an ethyl group, a propyl group, or a butyl group, or an aryl group, such as a phenyl group, may be mentioned.

In the above formula (3), $Y^4$ represents a single bond or a saturated or an unsaturated alkylene group. As the alkylene group, a methylene group, an ethylene group, a propylene group, or a butylene group is preferable, and among these mentioned above, in view of mechanical strength, a methylene group is preferable. As the substituent, for example, an alkyl group, such as a methyl group, an ethyl group, a propyl group, or a butyl group, or an aryl group, such as a phenyl group, may be mentioned. Among these mentioned above, a methyl group is preferable. In addition, $Y^4$ may represent a group having a ring structure formed by bonding between substituents. As the group having a ring structure formed by bonding between substituents, for example, a cycloalkylidene group, such as a cyclopentylidene group, a cyclohexylidene group, or a cycloheptylidene group, may be mentioned. Among these mentioned above, a cyclohexylidene group is preferable.

Hereinafter, particular examples of the repeating structural unit represented by the above formula (3) will be shown.

[Chem. 12]

(3-1)

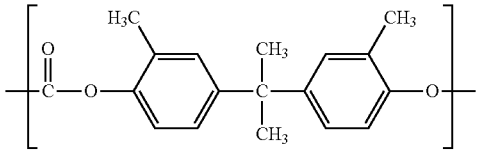

(3-2)

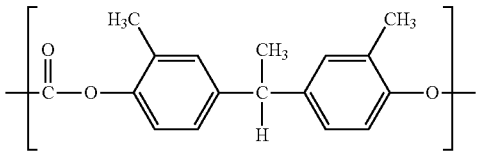

-continued (3-3)

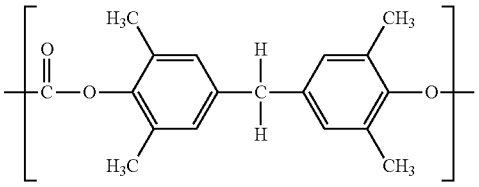

(3-4)

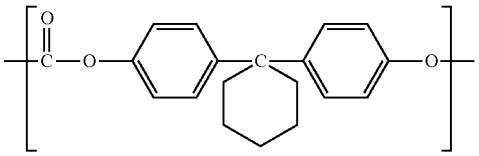

(3-5)

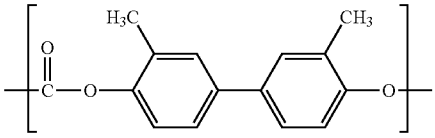

Among these examples, the repeating structural units represented by the above formulas (3-2) and (3-4) are preferable.

In addition, the polycarbonate resin A used in the present invention is a polycarbonate resin in which with respect to the total mass of the polycarbonate resin A, 10 to 40 percent by mass of a siloxane moiety is contained.

In the present invention, the siloxane moiety is a segment containing two silicon atoms located at two ends of the siloxane moiety and groups boned to the above two silicon atoms; at least one oxygen atom and at least one silicon atom located therebetween; and groups boned to the above oxygen atom and silicon atom. In more particular, for example, in the case of the repeating structural unit represented by the following formula (1-S), the siloxane moiety in the present invention is a segment surrounded by the following dotted line.

[Chem. 13]

(1-S)

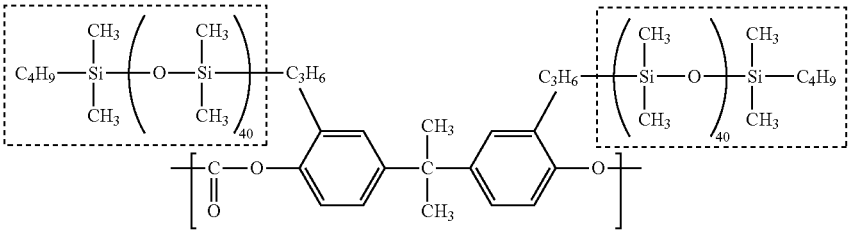

In addition, when the repeating structural unit is represented by the following formula (1-T), the siloxane moiety is a segment surrounded by the following dotted line.

[Chem. 14]

(1-T)

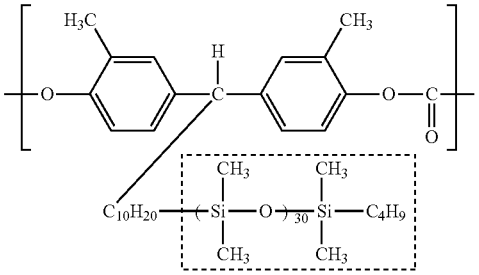

When the content of the siloxane moiety to the total mass of the polycarbonate resin A is 10 percent by mass or more, the effect of reducing contact stress can be continuously obtained. In addition, when the content of the siloxane moiety is 10 percent by mass or more, the domains are efficiently formed in the matrix formed from the charge transport material and at least one of the polyester resin C and the polycarbonate resin D. In addition, when the content of the siloxane moiety is 40 percent by mass or less, the charge transport material is suppressed from forming agglomerate in the domains formed from the polycarbonate resin A, and as a result, the potential variation is suppressed.

The content of the siloxane moiety in the polycarbonate resin A of the present invention can be analyzed by a general analytical method. Hereinafter, examples of the analytical method will be described.

After the charge transport layer, which is a surface layer of the electrophotographic photosensitive member, is dissolved in a solvent, by using a preparative isolation apparatus, such as size exclusion chromatography or high performance liquid chromatography, which is able to isolate and recover composition components, various materials contained in the charge transport layer, which is the surface layer, are isolated and recovered. The polycarbonate resin A isolated and recovered is hydrolyzed in the presence of an alkali into a carboxylic acid component and a bisphenol component. After a nuclear magnetic resonance spectrum analysis or a mass analysis is performed for the bisphenol component thus obtained, the repeat number of the siloxane moiety and the mole ratio thereof are calculated and are then converted into the content (mass ratio).

Although the polycarbonate resin A used in the present invention is a copolymer having the repeating structural unit represented by the above formula (1) or (101), the repeating structural unit represented by the above formula (2), and the repeating structural unit represented by the above formula (3) (preferably a terpolymer thereof), the copolymerization form may be any one of block copolymerization, random copolymerization, alternating copolymerization, and the like.

The weight average molecular weight (Mw) of the polycarbonate resin A used in the present invention is preferably in a range of 30,000 to 200,000 when the domains are formed in the matrix formed from the charge transport material and at least one of the polyester resin C and the polycarbonate resin D. Furthermore, the weight average molecular weight is more preferably in a range of 40,000 to 150,000.

In the present invention, the weight average molecular weight (Mw) of the resin is a polystyrene-conversion weight average molecular weight measured in accordance with an ordinary method, that is, in more particular, by the method disclosed in Japanese Patent Laid-Open No. 2007-79555.

The copolymerization ratio of the polycarbonate resin A used in the present invention can be confirmed by the conversion method using the peak area ratio of hydrogen atoms (hydrogen atoms forming the resin) obtained by $^1$H-NMR measurement of a resin which is a general measurement method.

The polycarbonate resin A used in the present invention can be synthesized, for example, by a direct reaction (phosgene method) between a bisphenol compound and phosgene or an ester exchange reaction (ester exchange method) between a bisphenol compound and a bisaryl carbonate.

In the above formula (C), $R^{21}$ to $R^{28}$ independently represent a hydrogen atom or a saturated or an unsaturated alkyl group. As the alkyl group, for example, a methyl group, an ethyl group, a propyl group, or a butyl group may be mentioned. Among these mentioned above, a methyl group is preferable. As the substituent, for example, an alkyl group, such as a methyl group, an ethyl group, a propyl group, or a butyl group, or an aryl group, such as a phenyl group, may be mentioned.

In the above formula (C), $X^3$ represents a saturated or an unsaturated alkylene group, a saturated or an unsaturated arylene group, a saturated or an unsaturated biphenylene group, or a divalent group in which at least two phenylene groups are boned to each other with an alkylene group or an oxygen atom interposed therebetween. Among these mentioned above, a saturated or an unsaturated arylene group or a divalent group in which at least two phenylene groups are bonded to each other with an alkylene group or an oxygen atom is preferable. As the alkylene group, for example, an alkylene group having 4 to 8 carbon atoms may be mentioned. Among these mentioned above, a butylene group, a hexylene group, or an octylene group is preferable. As the arylene group, for example, a phenylene group (an o-phenylene group, a m-phenylene group, or a p-phenylene group) or a naphthylene group may be mentioned. Among these mentioned above, a m-phenylene group or a p-phenylene group is preferable. Furthermore, these compounds mentioned above are preferably used in combination instead of being used alone. When a m-phenylene group and a p-phenylene group are used in combination, the ratio (molar ratio) of the m-phenylene group to the p-phenylene group is preferably 1:9 to 9:1 and more preferably 3:7 to 7:3. As the phenylene groups of the divalent group in which at least two phenylene groups are bonded to each other with an alkylene group or an oxygen atom interposed therebetween, for example, an o-phenylene group, a m-phenylene group, and a p-phenylene group may be mentioned. Among these mentioned above, a p-phenylene group is preferable. As the alkylene group which bonds between at least two phenylene groups, a saturated or an unsaturated alkylene group having 1 to 4 carbon atoms forming a main chain thereof is preferable. Among these mentioned above, a methylene group is preferable. As the substituent, for example, an alkyl group, such as a methyl group, an ethyl group, a propyl group, or a butyl group, or an aryl group, such as a phenyl group, may be mentioned. Among these mentioned above, a methyl group is preferable.

In the above formula (C), $Y^2$ represents a single bond or a saturated or an unsaturated alkylene group. As the alkylene group, a methylene group, an ethylene group, a propylene group, or a butylene group is preferable, and among these mentioned above, in view of mechanical strength, a methylene group is preferable. As the substituent, for example, an alkyl group, such as a methyl group, an ethyl group, a propyl group, or a butyl group, or an aryl group, such as a phenyl group, may be mentioned. Among these mentioned above, a methyl group is preferable. In addition, $Y^2$ may represent a group having a ring structure formed by bonding between substituents. As the group having a ring structure formed by bonding between substituents, for example, a cycloalkylidene group, such as a cyclopentylidene group, a cyclohexylidene group, or a cycloheptylidene group, may be mentioned. Among these mentioned above, a cyclohexylidene group is preferable. In addition, the polyester resin C having the repeating structural unit represented by the above formula (C) may be a copolymer which has at least two types of repeating structural units represented by the above formula (C). In addition, the copolymerization form thereof may be any one of alternating copolymerization, random copolymerization, and block copolymerization.

Hereinafter, particular examples of the repeating structural unit represented by the above formula (C) will be shown.

[Chem. 15]

(4-1)

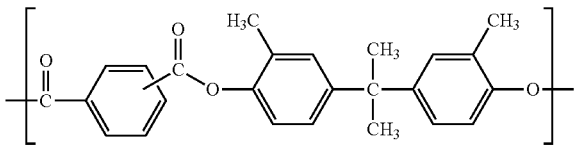

(4-2)

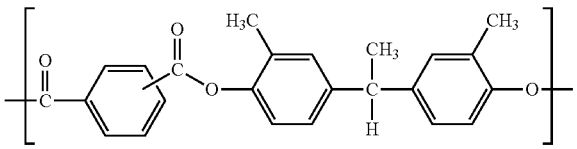

-continued
(4-3)
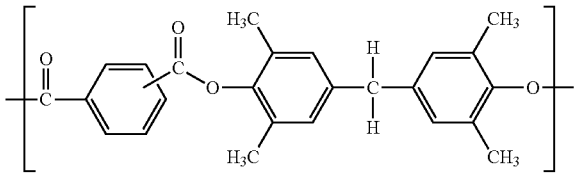
(4-4)
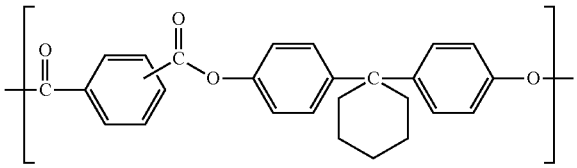
(4-5)
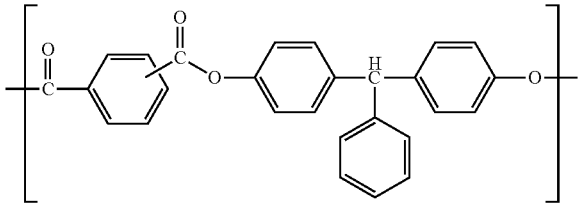
(4-6)
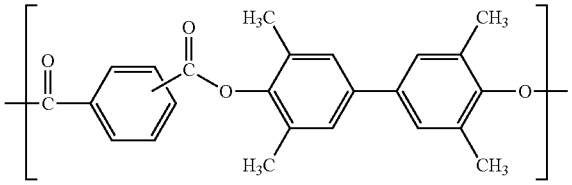
(4-7)
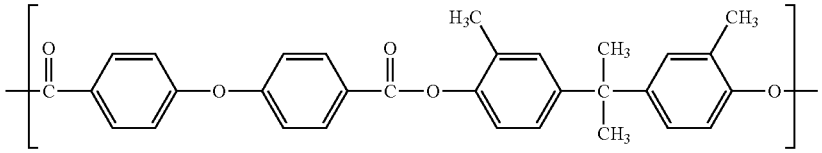
(4-8)
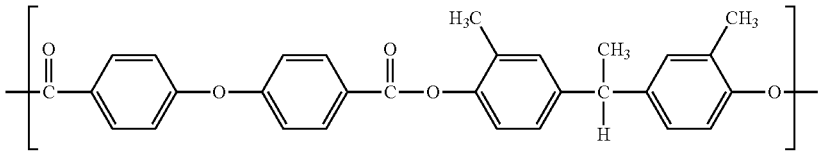
(4-9)
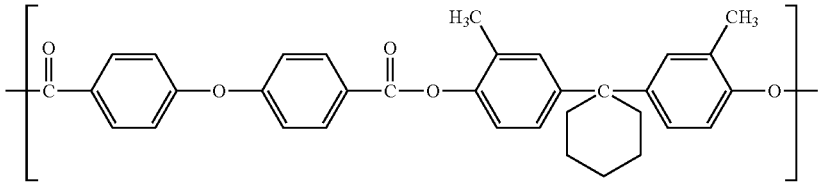
(4-10)
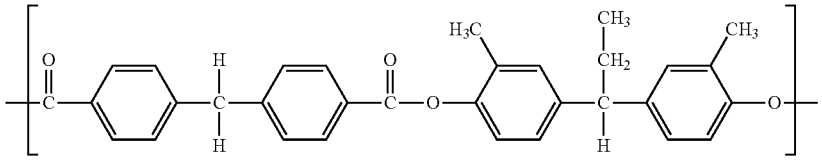
(4-11)
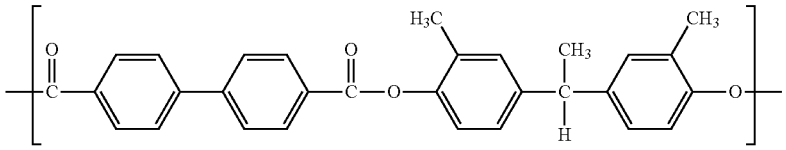
(4-12)
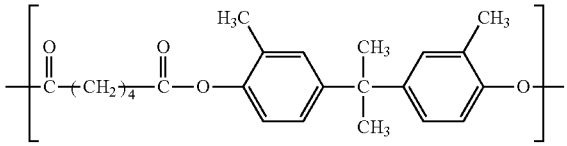
(4-13)
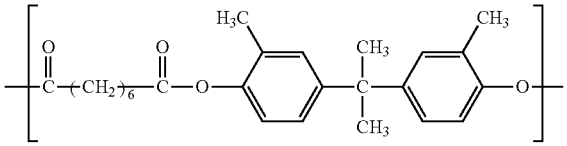

-continued (4-14)

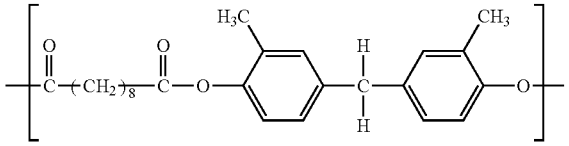

Among these examples, the repeating structural units represented by the above formulas (4-1), (4-2), (4-3), (4-6), (4-7), and (4-8) are preferable.

In the above formula (D), $R^{31}$ to $R^{38}$ independently represent a hydrogen atom or a saturated or an unsaturated alkyl group. As the alkyl group, for example, a methyl group, an ethyl group, a propyl group, or a butyl group may be mentioned. Among these mentioned above, a methyl group is preferable. As the substituent, for example, an alkyl group, such as a methyl group, an ethyl group, a propyl group, or a butyl group, or an aryl group, such as a phenyl group, may be mentioned.

In the above formula (D), $Y^3$ represents a single bond or a saturated or an unsaturated alkylene group. As the alkylene group, a methylene group, an ethylene group, a propylene group, or a butylene group is preferable, and among these mentioned above, in view of mechanical strength, a methylene group is preferable. As the substituent, for example, an alkyl group, such as a methyl group, an ethyl group, a propyl group, or a butyl group, or aryl group, such as a phenyl group, may be mentioned. Among these mentioned above, a methyl group is preferable. In addition, $Y^3$ may represent a group having a ring structure formed by bonding between substituents. As the group having a ring structure formed by bonding between substituents, for example, a cycloalkylidene group, such as a cyclopentylidene group, a cyclohexylidene group, or a cycloheptylidene group, may be mentioned. Among these mentioned above, a cyclohexylidene group is preferable. In addition, the polycarbonate resin D having the repeating structural unit represented by the above formula (D) may be a copolymer having at least two types of repeating structural units represented by the above formula (D). In addition, the copolymerization form thereof may be any one of alternating copolymerization, random copolymerization, and block copolymerization.

Hereinafter, particular examples of the repeating structural unit represented by the above formula (D) will be shown.

[Chem. 16]

(5-1)

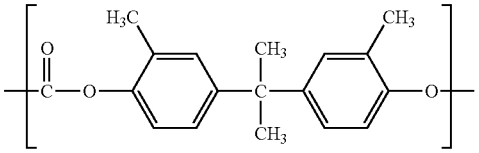

(5-2)

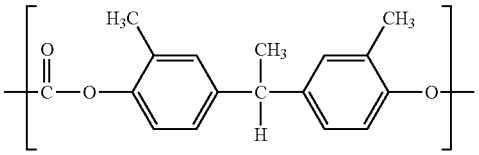

-continued (5-3)

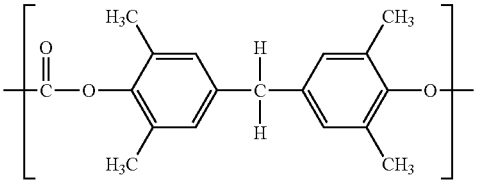

(5-4)

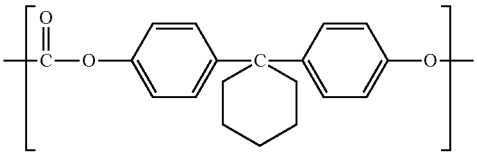

(5-5)

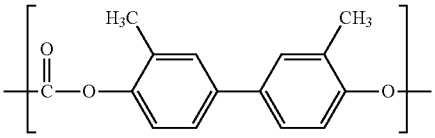

(5-6)

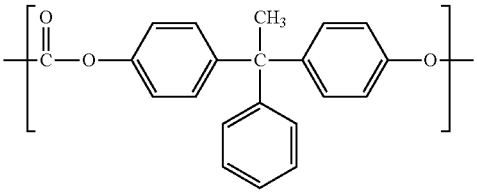

Among these examples, the repeating structural units represented by the above formulas (5-1), (5-2), (5-4), and (5-5) are preferable.

The charge transport layer of the electrophotographic photosensitive member of the present invention has a matrix-domain structure including a matrix formed from the charge transport material and at least one of the polyester resin C and the polycarbonate resin D and domains formed in this matrix from the polycarbonate resin A. In the matrix-domain structure of the present invention, the matrix corresponds to the sea of a "sea island structure", and the domains correspond to the islands thereof.

The domains formed from the polycarbonate resin A each have a particle shape (island shape) structure formed in the matrix formed from the charge transport material and at least one of the polyester resin C and the polycarbonate resin D. The domains formed from the polycarbonate resin A are independently present in the above matrix. The state of the matrix-domain structure as described above can be confirmed by performing surface observation of the charge transport layer or cross-sectional observation thereof.

The measurement of the domains and the state of the matrix-domain structure can be performed, for example, using a microscope, such as a laser beam microscope, an optical microscope, an electron microscope, and an atomic force microscope.

The number average particle diameter of the domains formed from the polycarbonate resin A of the present invention is preferably in a range of 100 to 500 nm. In addition, the particle diameter distribution of the domains is preferable narrowed in view of the uniformity of the film of the charge transport layer and that of the effect of reducing contact stress.

The number average particle diameter of the present invention is calculated in such a way that after the charge transport layer of the present invention is vertically cut, 100 domains observed by a microscope are optionally selected, and the maximum diameters of the domains thus cut are averaged.

In order to form the matrix-domain structure of the present invention, the content of the siloxane moiety in the polycarbonate resin A is preferably in a range of 2 to 20 percent by mass to the total mass of the polycarbonate resin A, the polyester resin C, and the polycarbonate resin D in the charge transport layer. In addition, in order to simultaneously achieve the reduction of the contact stress and the potential stability in a repeated use, the content of the siloxane moiety in the polycarbonate resin A is also preferably in a range of 2 to 20 percent by mass to the total mass of the polycarbonate resin A, the polyester resin C, and the polycarbonate resin D in the charge transport layer. Furthermore, the content is more preferably in a range of 2 to 10 percent by mass.

The matrix-domain structure of the charge transport layer of the electrophotographic photosensitive member of the present invention can be formed using a charge transport-layer coating liquid containing the charge transport material, the polycarbonate resin A, and at least one of the polyester resin C, and polycarbonate resin D. In addition, the above matrix-domain structure can also be formed by using a charge transport-layer coating liquid containing the polycarbonate resin A forming domains and only at least one of the polyester resin C and the polycarbonate resin D, each of which forms a matrix. In addition, when the charge transport layer is formed using a charge transport-layer coating liquid containing a charge transport material and a polycarbonate resin having a siloxane moiety, the charge transport material may form agglomerate in the polycarbonate resin having a siloxane moiety. The matrix-domain structure of the present invention is different from the structure in which the above agglomerate of the charge transport material is formed. In the electrophotographic photosensitive member of the present invention which has the charge transport layer of the matrix-domain structure in which the domains are formed from the polycarbonate resin A in the matrix formed from the charge transport material and at least one of the polyester resin C and the polycarbonate resin D, the potential characteristics are stably maintained. Although the reason for this has not been clearly understood, the inventors of the present invention believe as follows.

That is, the matrix-domain structure of the charge transport layer of the electrophotographic photosensitive member of the present invention is the structure in which the polycarbonate resin A forms the domains in the matrix formed from the charge transport material and at least one of the polyester resin C and the polycarbonate resin D. In this case, since the matrix is formed from the charge transport material and at least one of the polyester resin C and the polycarbonate resin D, excellent charge transport ability can be maintained. In addition, it is believed that when the agglomerate of the charge transport material is not confirmed in the domains formed from the polycarbonate resin A, the charge transport ability is not degraded by the agglomeration of the charge transport material. In addition, it is believed that since the domains formed from the polycarbonate resin A are contained in the charge transport layer, the effect of reducing contact stress can be continuously maintained.

Furthermore, it is believed that since a specific amount of the repeating structural unit (diphenyl ether carbonate structures) represented by the above formula (2) is contained in the structure of the polycarbonate resin A which forms the domains of the matrix-domain structure of the present invention, the domains can be easily formed in the matrix formed from at least one of the polyester resin C and the polycarbonate resin D. The reason for this is believed that the polyester resin C and the polycarbonate resin D, each of which forms the matrix, have carbonate bonds and many aromatic ring structures, which are likely to spatially spread, and in addition, the polycarbonate resin A has a diphenyl ether carbonate structure. That is, the ether structure is likely to bend, and hence the polycarbonate resin A may be relatively freely arranged in space. Furthermore, the siloxane moiety of the polycarbonate resin A is grafted to a side chain of bisphenol, and hence a terminal group of the siloxane moiety can freely move. By these two reasons, the polycarbonate resin A is likely to form the domains. In particular, the content of the repeating structural unit (diphenyl ether carbonate structure) represented by the above formula (2) in the polycarbonate resin A is preferably in a range of 5 to 50 percent by mass to the total mass of the polycarbonate resin A. When the content of the diphenyl ether carbonate structures is less than 5 percent by mass, since the polycarbonate resin A is liable to spatially spread, the separation is promoted at the stage when the charge transport-layer coating liquid is prepared, and extreme separation from the polyester resin C and/or the polycarbonate resin D, each of which is the resin forming the matrix, is liable to be promoted. As a result, since the domains of the matrix-domain structure of the present invention cannot be formed, the optical transmittance of the charge transport layer is decreased, and/or the charge transport material is agglomerated or precipitated on the surface, so that the potential stability is degraded. When the content of the diphenyl ether carbonate structure is more than 50 percent by mass, materials other than the polycarbonate resin A are also liable to be incorporated into the domains, and hence the size of the domain becomes non-uniform. As a result, a larger part of the charge transport material is incorporated in the domain, and as a result, the charge transport ability is degraded.

In addition, since the siloxane moiety in the polycarbonate resin A is grafted to the side chain of bisphenol, which is in the state different from that in which the siloxane moiety in the polycarbonate resin A is block copolymerized at each of the two terminals of the main chain, the domains may be easily formed between siloxane moieties. The domains formed as described above and the charge transport material having an aromatic ring structure have inferior compatibility to each other, and as a result, the amount of the charge transport material contained in the domains is decreased, and the degradation in charge transporting ability caused by agglomeration of the charge transport material can be suppressed.

Hereinafter, synthetic examples of the polycarbonate resin A used in the present invention will be described.

SYNTHETIC EXAMPLE 1

Synthesis of Polycarbonate Resin A (1) Having Repeating Structural Units Represented by the Above Formulas (1-1), (2-1), and (3-4).

First, 15.4 g of 2,2-bis(4-hydroxy-3-allylphenyl)propane (manufactured by API Corporation) was added to 150 g of toluene and 0.10 g of a toluene solution of platinum vinyl siloxane complex at a platinum concentration of 1% and was then heated to 80° C. To the solution thus prepared, 165 g of dimethylsiloxane having one end terminated by a hydrogen atom (the number of the repeating units: 20) was dripped, and after the dripping was finished, a reaction was performed at 110° C. for 3 hours. After the reaction was finished, toluene was removed under reduced pressure, so that a compound represented by the following formula (6) was obtained.

[Chem. 17]

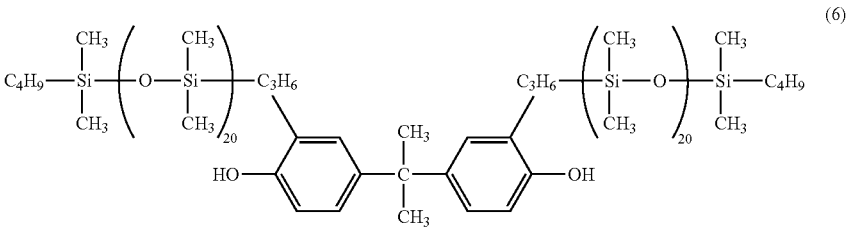

(6)

Next, 23 g of a diol having a siloxane moiety represented by the following formula (6), 20 g of a diol (manufactured by DIC Corp.) represented by the following formula (7), and 57 g of a diol (manufactured by Honshu Chemical Industry Co., Ltd.) represented by the following formula (8) were dissolved in 1,100 ml of an aqueous sodium hydroxide solution at a concentration of 5 percent by mass. Next, 0.1 g of hydrosulfite was added to the solution thus prepared and was then stirred. Subsequently, 500 ml of methylene chloride was added to the above solution and was maintained at 15° C. while stirring was performed, and 30 g of phosgene was then blown into the solution for 40 minutes.

[Chem. 18]

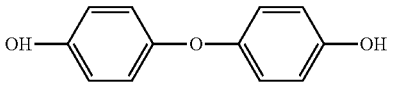

(7)

[Chem. 19]

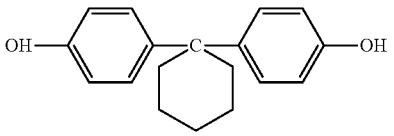

(8)

After phosgene was blown, 0.48 g of p-t-butylphenol (manufactured by DIC Corp.) was added as a molecular weight modifier, followed by vigorous stirring, so that a reaction liquid was emulsified. Next, 0.4 ml of triethylamine was added after the emulsification, followed by performing stirring at 20° C. to 25° C. for 1 hour, so that polymerization was performed.

After the polymerization was finished, the reaction liquid was separated into an aqueous phase and an organic phase, and the organic phase was neutralized by phosphoric acid and was repeatedly washed with water until the conductivity of a wash phase (aqueous phase) reached 10 μS/cm or less. After a polymer solution thus obtained was dripped to warm water maintained at 45° C., the solvent was removed by evaporation, so that a white powdered precipitate was obtained. After being filtrated, the precipitate thus obtained was dried at 105° C. for 24 hours, so that 80 g of the polycarbonate resin A (1) having the repeating structural units represented by the above formulas (1-1), (2-1), and (3-4) was obtained. The results are shown in Table 1. When the content of the siloxane moiety of the polycarbonate resin A (1) was calculated as described above, it was 21 percent by mass. The weight average molecular weight of the polycarbonate resin A (1) was 60,000. The results are shown in Table 1.

SYNTHETIC EXAMPLE 2

Synthesis of Polycarbonate Resin A (101) Having Repeating Structural Units Represented by the Above Formulas (101-1), (2-1), and (3-4).

First, 36.6 g of 1,1-bis(4-hydroxy-3-methylphenyl)-10-undecene (manufactured by API Corporation), 150 g of toluene, and 0.10 g of a toluene solution of platinum vinyl siloxane complex at a platinum concentration of 1% were received in a separable flask having a volume of 500 ml, and the mixture thus prepared was then heated to 80° C. To the solution thus prepared, 234 g of dimethylsiloxane terminated by hydrogen atoms (the number of repeating units: 30) was dripped, and after the dripping was finished, a reaction was performed at 110° C. for 3 hours. After the reaction was finished, toluene was removed under reduced pressure, so that a compound represented by the following formula (106) was obtained.

[Chem. 20]

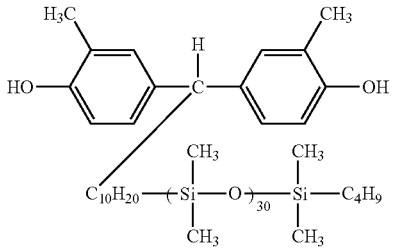

(106)

Next, 24 g of a diol having a siloxane moiety represented by the following formula (106), 20 g of a diol (manufactured by DIC Corp.) represented by the following formula (7), and 55 g of a diol (manufactured by Honshu Chemical Industry Co., Ltd.) represented by the following formula (8) were dissolved in 1,100 ml of an aqueous sodium hydroxide solution at a concentration of 5 percent by mass. Next, 0.1 g of hydrosulfite was added to the solution thus prepared and was then stirred. Subsequently, 500 ml of methylene chloride was added to the above solution and was maintained at 15° C. while stirring was performed, and 30 g of phosgene was then blown into the solution for 40 minutes.

After phosgene was blown, 0.48 g of p-t-butylphenol (manufactured by DIC Corp.) was added as a molecular weight modifier, followed by vigorous stirring, so that a reaction liquid was emulsified. Next, 0.4 ml of triethylamine was added after the emulsification, followed by performing stirring at 20° C. to 25° C. for 1 hour, so that polymerization was performed.

After the polymerization was finished, the reaction liquid was separated into an aqueous phase and an organic phase, and the organic phase was neutralized by phosphoric acid and was then repeatedly washed with water until the conductivity of a wash phase (aqueous phase) reached 10 μS/cm or less. After a polymer solution thus obtained was dripped to warm water maintained at 45° C., the solvent was removed by evaporation, so that a white powdered precipitate was obtained. After being filtrated, the precipitate thus obtained was dried at 105° C. for 24 hours, so that 80 g of the polycarbonate resin A (101) having the repeating structural units represented by the above formulas (101-1), (2-1), and (3-4) was obtained. The results are shown in Table 2. When the content of the siloxane moiety of the polycarbonate resin A (101) was calculated as described above, it was 21 percent by mass. The weight average molecular weight of the polycarbonate resin A (101) was 60,000. The results are shown in Table 2.

In addition, by using a method similar to the above synthetic method shown in the synthetic example of the polycarbonate resin A, polycarbonate resins shown in Table 1 and 2 were formed.

TABLE 1

| POLY-CARBONATE RESIN | REPEATING STRUCTURAL UNIT REPRESENTED BY FORMULA (1) | REPEATING STRUCTURAL UNIT REPRESENTED BY FORMULA (2) | REPEATING STRUCTURAL UNIT REPRESENTED BY FORMULA (3) | CONTENT OF SILOXANE MOIETY IN POLY-CARBONATE RESIN (PERCENT BY MASS) | CONTENT OF FORMULA (2) IN POLY-CARBONATE RESIN (PERCENT BY MASS) | WEIGHT AVERAGE MOLECULAR WEIGHT (Mw) |
|---|---|---|---|---|---|---|
| A(1) | (1-1) | (2-1) | (3-4) | 21 | 20 | 60000 |
| A(2) | (1-1) | (2-1) | (3-4) | 30 | 20 | 40000 |
| A(3) | (1-1) | (2-1) | (3-4) | 25 | 30 | 100000 |
| A(4) | (1-1) | (2-1) | (3-4) | 15 | 30 | 150000 |
| A(5) | (1-1) | (2-1) | (3-4) | 10 | 5 | 50000 |
| A(6) | (1-1) | (2-1) | (3-4) | 15 | 20 | 110000 |
| A(7) | (1-1) | (2-1) | (3-4) | 10 | 50 | 80000 |
| A(8) | (1-1) | (2-1) | (3-4) | 10 | 40 | 120000 |
| A(9) | (1-1) | (2-1) | (3-4) | 40 | 5 | 70000 |
| A(10) | (1-1) | (2-1) | (3-4) | 40 | 10 | 120000 |
| A(11) | (1-1) | (2-1) | (3-4) | 35 | 40 | 40000 |
| A(12) | (1-1) | (2-1) | (3-4) | 40 | 50 | 105000 |
| A(13) | (1-1)/(1-4) | (2-1) | (3-2) | 30 | 25 | 60000 |
| A(14) | (1-2) | (2-1) | (3-2) | 15 | 25 | 60000 |
| A(15) | (1-3) | (2-1) | (3-2) | 25 | 30 | 60000 |
| A(16) | (1-4) | (2-1) | (3-1) | 30 | 20 | 60000 |
| A(17) | (1-5) | (2-2) | (3-2) | 21 | 25 | 40000 |
| A(18) | (1-5) | (2-2) | (3-4) | 25 | 50 | 90000 |
| A(19) | (1-6) | (2-1) | (3-2) | 21 | 25 | 60000 |
| A(20) | (1-7) | (2-3) | (3-3) | 10 | 20 | 60000 |
| A(21) | (1-8) | (2-1) | (3-2) | 21 | 30 | 60000 |
| A(22) | (1-9) | (2-1) | (3-5) | 30 | 45 | 60000 |
| A(23) | (1-10) | (2-4) | (3-2) | 21 | 20 | 60000 |
| A(24) | (1-11) | (2-1) | (3-2) | 25 | 20 | 40000 |
| A(25) | (1-12) | (2-5) | (3-2) | 30 | 30 | 80000 |
| A(26) | (1-13) | (2-1) | (3-1) | 21 | 20 | 60000 |
| A(27) | (1-1) | (2-1) | (3-1) | 8 | 30 | 60000 |
| A(28) | (1-1) | (2-1) | (3-1) | 50 | 30 | 60000 |
| A(29) | (1-1) | (2-1) | (3-1) | 30 | 3 | 60000 |
| A(30) | (1-1) | (2-1) | (3-1) | 25 | 60 | 60000 |
| A(31) | (1-1) | — | (3-2) | 30 | 0 | 55000 |
| A(32) | (G) | (2-2) | (3-2) | 20 | 10 | 60000 |
| A(33) | (H) AT TERMINAL | (2-2) | (3-2) | 8 | 10 | 80000 |
| A(34) | (I) | (2-2) | (3-2) | 30 | 10 | 70000 |
| A(35) | (1-14) | (2-1) | (3-1) | 25 | 10 | 75000 |
| A(36) | (1-15) | (2-1) | (3-1) | 25 | 10 | 80000 |
| A(37) | (1-16) | (2-1) | (3-1) | 25 | 10 | 70000 |
| A(38) | (1-2) | (2-1) | (3-4) | 20 | 20 | 72000 |
| A(39) | (1-2) | (2-6) | (3-4) | 20 | 20 | 60000 |
| A(40) | (1-2) | (2-7) | (3-4) | 20 | 20 | 60000 |

TABLE 2

| POLY-CARBONATE RESIN | REPEATING STRUCTURAL UNIT REPRESENTED BY FORMULA (101) | REPEATING STRUCTURAL UNIT REPRESENTED BY FORMULA (2) | REPEATING STRUCTURAL UNIT REPRESENTED BY FORMULA (3) | CONTENT OF SILOXANE MOIETY IN POLY-CARBONATE RESIN (PERCENT BY MASS) | CONTENT OF FORMULA (2) IN POLY-CARBONATE RESIN (PERCENT BY MASS) | WEIGHT AVERAGE MOLECULAR WEIGHT (Mw) |
|---|---|---|---|---|---|---|
| A(101) | (101-1) | (2-1) | (3-4) | 21 | 20 | 60000 |
| A(102) | (101-1) | (2-1) | (3-4) | 30 | 20 | 40000 |
| A(103) | (101-1) | (2-1) | (3-4) | 25 | 30 | 100000 |
| A(104) | (101-1) | (2-1) | (3-4) | 15 | 30 | 150000 |
| A(105) | (101-1) | (2-1) | (3-4) | 10 | 5 | 50000 |
| A(106) | (101-1) | (2-1) | (3-4) | 15 | 20 | 110000 |
| A(107) | (101-1) | (2-1) | (3-4) | 10 | 50 | 80000 |
| A(108) | (101-1) | (2-1) | (3-4) | 10 | 40 | 120000 |
| A(109) | (101-1) | (2-1) | (3-4) | 40 | 5 | 70000 |
| A(110) | (101-1) | (2-1) | (3-4) | 40 | 10 | 120000 |
| A(111) | (101-1) | (2-1) | (3-4) | 35 | 40 | 40000 |
| A(112) | (101-1) | (2-1) | (3-4) | 40 | 50 | 105000 |
| A(113) | (101-1)/(101-4) | (2-1) | (3-2) | 30 | 25 | 60000 |
| A(114) | (101-2) | (2-1) | (3-2) | 15 | 25 | 60000 |
| A(115) | (101-3) | (2-1) | (3-2) | 25 | 30 | 60000 |
| A(116) | (101-4) | (2-1) | (3-1) | 30 | 20 | 60000 |
| A(117) | (101-5) | (2-2) | (3-2) | 21 | 25 | 40000 |
| A(118) | (101-5) | (2-2) | (3-4) | 25 | 50 | 90000 |
| A(119) | (101-6) | (2-1) | (3-2) | 21 | 25 | 60000 |
| A(120) | (101-7) | (2-3) | (3-3) | 10 | 20 | 60000 |
| A(121) | (101-8) | (2-1) | (3-2) | 21 | 30 | 60000 |
| A(122) | (101-9) | (2-1) | (3-5) | 30 | 45 | 60000 |
| A(123) | (101-10) | (2-4) | (3-2) | 21 | 20 | 60000 |
| A(124) | (101-11) | (2-1) | (3-2) | 25 | 20 | 40000 |
| A(125) | (101-12) | (2-5) | (3-2) | 30 | 30 | 80000 |
| A(126) | (101-13) | (2-1) | (3-1) | 21 | 20 | 60000 |
| A(127) | (101-1) | (2-1) | (3-1) | 8 | 30 | 60000 |
| A(128) | (101-1) | (2-1) | (3-1) | 50 | 30 | 60000 |
| A(129) | (101-1) | (2-1) | (3-1) | 30 | 3 | 60000 |
| A(130) | (101-1) | (2-1) | (3-1) | 25 | 60 | 60000 |
| A(131) | (101-1) | — | (3-2) | 30 | 0 | 55000 |
| A(132) | (L) | (2-2) | (3-2) | 20 | 10 | 60000 |
| A(135) | (101-14) | (2-1) | (3-1) | 25 | 10 | 75000 |
| A(136) | (101-15) | (2-1) | (3-1) | 25 | 10 | 80000 |
| A(137) | (101-16) | (2-1) | (3-1) | 25 | 10 | 70000 |
| A(138) | (101-2) | (2-1) | (3-4) | 20 | 20 | 68000 |
| A(139) | (101-2) | (2-6) | (3-4) | 20 | 20 | 63000 |
| A(140) | (101-2) | (2-7) | (3-4) | 20 | 20 | 62000 |

In addition, polycarbonate resin A (27) to A (34) and A (127) to A (132) are not the polycarbonate resin A used in the present invention but are polycarbonate resins used for comparative examples which will be described later.

(G) of the polycarbonate resin A (32) is a repeating structural unit represented by the following formula (G).

(H) of the polycarbonate resin A (33) is a terminal structure represented by the following formula (H). Although having no repeating structural unit represented by the above formula (1), the polycarbonate resin A (33) has the terminal structure represented by the following formula (H).

[Chem. 21]

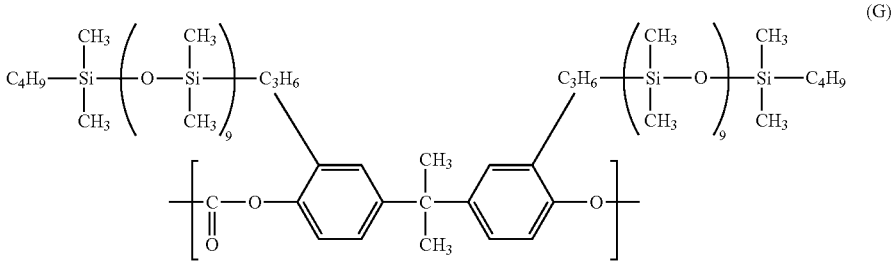

Instead of the above p-t-butylphenol, the synthesis can be performed using a molecular weight modifier corresponding to the terminal structure represented by the following formula (H).

[Chem. 22]

(H)

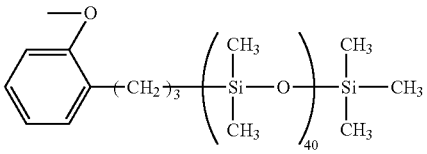

(I) of the polycarbonate resin A (34) is a repeating structural unit represented by the following formula (I).

[Chem. 23]

(I)

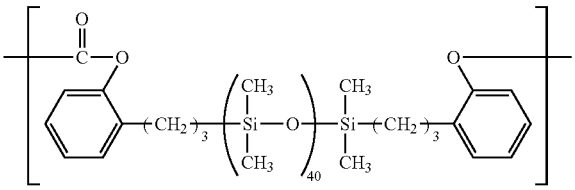

(L) of the polycarbonate resin A (132) is a repeating structural unit represented by the following formula (L).

[Chem. 24]

(L)

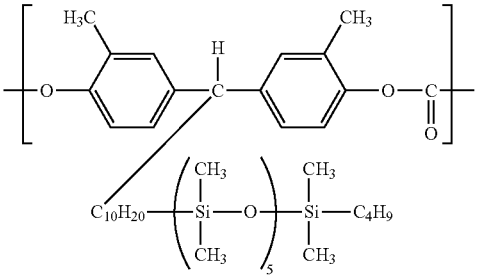

Although the charge transport layer which is a surface layer of the electrophotographic photosensitive member of the present invention contains the polycarbonate resin A and at least one of the polyester resin C and the polycarbonate resin D, at least one another resin may be further contained. As the at least one another resin which may be contained, for example, an acrylic resin, a polyester resin, or a polycarbonate resin may be mentioned.

In addition, in consideration of efficient formation of the above matrix-domain structure, the polyester resin C and the polycarbonate resin D preferably have no repeating structural unit represented by the above formula (1) or (101). Furthermore, in consideration of efficient formation of the above matrix-domain structure, in particular, the polyester resin C having no repeating structural unit represented by the above formula (1) or (101) is preferably used.

As the charge transport material contained in the charge transport layer which is the surface layer of the electrophotographic photosensitive member of the present invention, for example, triarylamine compound, a hydrazone compound, a styryl compound, or a stilbene compound may be mentioned. These charge transport materials may be used alone or in combination. In addition, among these mentioned above, as the charge transport material, a triarylamine compound is preferably used in view of improvement in electrophotographic properties.

Next, the structure of the electrophotographic photosensitive member of the present invention will be described.

As described above, the electrophotographic photosensitive member of the present invention is an electrophotographic photosensitive member which has a support, a charge generation layer provided thereon, and a charge transport layer provided on the charge generation layer. In addition, in this electrophotographic photosensitive member, the charge transport layer is a surface layer (topmost layer) thereof.

In addition, the charge transport layer of the electrophotographic photosensitive member of the present invention contains a charge transport material. In addition, the charge transport layer contains the polycarbonate resin A and at least one of the polyester resin C and the polycarbonate resin D.

Furthermore, the charge transport layer may be formed to have a laminate structure, and in this case, the matrix-domain structure described above is formed at least in an outermost charge transport layer (charge transport layer used as the surface layer). In general, although a cylindrical electrophotographic photosensitive member formed of a photosensitive layer provided on a cylindrical support is widely used as the electrophotographic photosensitive member, an electrophotographic photosensitive member having a belt shape, a sheet shape, or the like may also be used.

As the support, a support having conductivity (conductive support) is preferable, and a support made of a metal, such aluminum, an aluminum alloy, or stainless steel, may be used.

In the case in which a support is made of aluminum or an aluminum alloy, there may be used an ED tube, an EI tube, or one obtained by subjecting one of these tubes to cutting, electrolytic composite polishing (electrolysis performed using at least one electrode and an electrolytic solution, each having an electrolysis action, and polishing performed using grinding stones having a polishing action), or a wet or a dry honing treatment.

In addition, a metal-made support and a resin-made support, each coated with a layer formed by vacuum deposition of aluminum, an aluminum alloy, or an indium oxide-tin oxide alloy, may also be used.

In addition, a support made of conductive particles, such as carbon black, tin oxide particles, titanium oxide particles, or silver particles, impregnated in a resin or the like, or a support made of a plastic having a conductive binding resin may also be used.

In order to suppress the interference fringe by scattering of laser beams and the like, the surface of the support may be processed by a cutting treatment, a surface roughening treatment, an alumite treatment, or the like.

When a surface layer of the support is a layer provided to impart the conductivity, the volume resistivity of the layer is preferably $1\times10^{10}$ Ω·cm or less and is particularly preferably $1\times10^{6}$ Ω·cm or less.

Between the support and an interlayer which will be described later or the charge generation layer, a conductive layer may be provided in order to suppress the interference fringe by scattering of laser beams and the like and to cover scratches of the support. This conductive layer is a layer formed by using a conductive-layer coating liquid in which conductive particles are dispersed in a binding resin.

As the conductive particles, for example, there may be mentioned carbon black, acetylene black, a metal powder, such as aluminum, nickel, iron, Nichrome, copper, zinc or silver, or a metal oxide powder, such as conductive tin oxide or ITO.

In addition, as the binding resin, for example, there may be mentioned a polyester resin, a polycarbonate resin, a polyvinyl butyral, an acryl resin, a silicone resin, an epoxy resin, a melamine resin, a urethane resin, a phenol resin, or an alkyd resin.

As a solvent of the conductive-layer coating liquid, for example, an ether solvent, an alcohol solvent, a ketone solvent, or an aromatic hydrocarbon solvent may be mentioned.

The thickness of the conductive layer is preferably in a range of 0.2 to 40 μm, more preferably in a range of 1 to 35 μm, and even more preferably in a range of 5 to 30 μm.

A conductive layer in which conductive particles and/or resistance adjusting particles are dispersed has the tendency that the surface thereof is roughened.

Between the charge generation layer and the support or the conductive layer, an interlayer having a barrier function and/or an adhesion function may be provided. The interlayer is formed, for example, for adhesion improvement of the photosensitive layer, improvement in coating properties, improvement in charge injection properties from the support, and/or protection against electrical breakdown of the photosensitive layer.

The interlayer can be formed by applying an interlayer coating liquid containing a binding resin on the conductive layer, followed by performing drying or curing.

As the binding resin for the interlayer, for example, there may be mentioned a poly(acrylic acid), a methyl cellulose, an ethyl cellulose, a polyamide resin, a polyimide resin, a poly (amide imide) resin, a poly(amide acid) resin, a melamine resin, an epoxy resin, or a polyurethane resin.

In order to effectively obtain electrical barrier properties of the interlayer and in order to optimize the coating properties, the adhesion, the solvent resistance, and the electrical resistance, the binding resin of the interlayer is preferably a thermoplastic resin. In particular, a thermoplastic polyamide resin is preferable. As the polyamide resin, a low crystalline or an amorphous copolyamide which can be applied in the form of a solution is preferable.

The thickness of the interlayer is preferably in a range of 0.05 to 7 μm and more preferably in a range of 0.1 to 2 μm.

In addition, in order not to disturb the flow of charges (carriers) in the interlayer, the interlayer may contain semiconductive particles and/or an electron transport material (an electron accepting material such as an acceptor).

The charge generation layer is provided on the support, the conductive layer, or the interlayer.

As a charge generation material used for the electrophotographic photosensitive member of the present invention, for example, an azo pigment, a phthalocyanine pigment, an indigo pigment, or a perylene pigment may be mentioned. These charge generation materials may be used alone or in combination. Among these mentioned above, a metal phthalocyanine, such as oxy titanium phthalocyanine, hydroxy gallium phthalocyanine, or chloro-gallium phthalocyanine is preferably used since it has high sensitivity.

As a binding resin used for the charge generation layer, for example, there may be mentioned a polycarbonate resin, a polyester resin, a butyral resin, a polyvinyl acetal resin, an acryl resin, a vinyl acetate resin, or a urea resin. Among these mentioned above, a butyral resin is particularly preferable. These mentioned above may be used alone or in combination, and copolymers thereof may also be used alone or in combination.

The charge generation layer can be formed by applying a charge generation-layer coating liquid in which the charge generation material is dispersed together with the binding resin and a solvent, followed by drying. In addition, the charge generation layer may be a film formed by depositing the charge generation material.

As a dispersing method, for example, there may be mentioned a method using a homogenizer, an ultrasonic wave, a ball mill, a sand mill, an attritor, or a roll mill.

The ratio of the charge generation material to the binding resin is preferably in a range of 1:10 to 10:1 (mass ratio) and, in particular, more preferably in a range of 1:1 to 3:1 (mass ratio).

A solvent used for the charge generation-layer coating liquid is selected in consideration of the solubility and the dispersion stability of the binging resin and the charge generation material which are to be used. As an organic solvent, for example, an alcohol solvent, a sulfoxide solvent, a ketone solvent, an ether solvent, an ester solvent, or an aromatic hydrocarbon solvent may be mentioned.

The thickness of the charge generation layer is preferably 5 μm or less and more preferably in a range of 0.1 to 2 μm.

In addition, whenever necessary, various additives, such as a sensitizer, an antioxidant, an ultraviolet ray absorbent, and a plasticizer, may also be added to the charge generation layer. In addition, in order not to disturb the flow of charges (carriers) in the charge generation layer, the charge generation layer may contain an electron transport material (an electron accepting material such as an acceptor).

The charge transport layer is provided on the charge generation layer.

The charge transport material used for the electrophotographic photosensitive member of the present invention is as described above.

Although the charge transport layer, which is the surface layer of the electrophotographic photosensitive member of the present invention, contains the polycarbonate resin A and at least one of the polyester resin C and the polycarbonate resin D, at least one another resin may be further contained as described above. The at least one another resin which may be contained is as described above.

The charge transport layer can be formed by applying a charge transport-layer coating liquid in which the charge transport material and the above resins are dissolved in a solvent, followed by drying.

The ratio of the charge transport material to the binding resin is preferably in a range of 4:10 to 20:10 (mass ratio) and more preferably in a range of 5:10 to 12:10 (mass ratio).

As the solvent used for the charge transport-layer coating liquid, for example, there may be mentioned a ketone solvent, an ester solvent, an ether solvent, or an aromatic hydrocarbon solvent may be mentioned. These solvents mentioned above may be used alone or in combination. Among these solvents mentioned above, in view of resin solubility, an ether solvent or an aromatic hydrocarbon solvent is preferably used.

The thickness of the charge transport layer is preferably in a range of 5 to 50 μm and more preferably in a range of 10 to 35 μm.

In addition, to the charge transport layer, whenever necessary, an antioxidant, an ultraviolet ray absorbent, a plasticizer, and the like may also be added.

Various additives may be added to the individual layers of the electrophotographic photosensitive member of the present invention. As the additives, for example, an antidegradant, such as an antioxidant, an ultraviolet ray absorbent, or a stabilizer against light, or fine particles, such as organic or inorganic fine particles, may be mentioned. As the antidegradant, for example, a hindered phenol antioxidant, a hindered amine stabilizer against light, a sulfur atom-containing antioxidant, or a phosphorus atom-containing antioxidant may be mentioned. As the organic fine particles, for example, there may be mentioned resin particles, such as fluorine atom-containing resin particles, polystyrene fine particles, or polyethylene resin particles. As the inorganic fine particles, for example, particles of a metal oxide, such as silica or alumina, may be mentioned.

When the coating liquid for each layer is applied, for example, there may be used a coating method, such as a dip coating method (immersion coating method), a spray coating method, a spinner coating method, a roller coating method, a mayer bar coating method, or a blade coating method.

One example of a schematic structure of an electrophotographic apparatus including a process cartridge which has the electrophotographic photosensitive member of the present invention is shown in the FIGURE.

In the FIGURE, reference numeral 1 indicates a cylindrical electrophotographic photosensitive member, and the cylindrical electrophotographic photosensitive member 1 is rotated around a shaft 2 at a predetermined peripheral speed in an arrow direction.

The surface of the electrophotographic photosensitive member 1 which is rotated is uniformly charged at a positive or a negative predetermined potential by a charging unit (primary charging unit: charging roller or the like) 3. Subsequently, the surface of the electrophotographic photosensitive member 1 receives exposure light (image exposure light) 4 emitted from an exposure unit (not shown), such as slit exposure or laser beam scanning exposure. As described above, an electrostatic latent image corresponding to a target image is sequentially formed on the surface of the electrophotographic photosensitive member 1.

The electrostatic latent image formed on the surface of the electrophotographic photosensitive member 1 is developed by a toner contained in a developing powder of a developing unit 5, so that a toner image is obtained. Subsequently, the toner image formed and supported on the surface of the electrophotographic photosensitive member 1 is sequentially transferred to a transfer material (paper or the like.) P by a transfer bias from a transfer unit (transfer roller or the like) 6. In this case, the transfer material P is recovered from between the electrophotographic photosensitive member 1 and the transfer unit 6 (contact portion) by a transfer material supply unit (not shown) in synchronous with the rotation of the electrophotographic photosensitive member 1 and is then supplied.

After being separated from the surface of the electrophotographic photosensitive member 1, the transfer material P on which the toner image is transferred is supplied in a fixing unit 8 and is processed therein by image fixing, so that the transfer material P is printed out from the electrophotographic apparatus as an image-formed material (a print or a copy).

A developing powder (toner) remaining on the he surface of the electrophotographic photosensitive member 1 after the toner image transfer is removed by a cleaning unit (such as a cleaning blade) 7, so that the surface of the electrophotographic photosensitive member 1 is cleaned. Subsequently, after the surface of the electrophotographic photosensitive member 1 is processed by a neutralization treatment with pre-exposure light (not shown) emitted from a pre-exposure unit, the electrophotographic photosensitive member 1 is repeatedly used for image formation. As shown in the FIGURE, when the charging unit 3 is a contact charging unit using a charging roller or the like, the pre-exposure may not be always necessary.

At least two of the above components, such as the electrophotographic photosensitive member 1, the charging unit 3, the developing unit 5, the transfer unit 6, and the cleaning unit 7, may be received in a container and may be integrally combined with each other to form a process cartridge, and the process cartridge thus formed may be detachably mountable to a main body of an electrophotographic apparatus, such as a copying machine or a laser beam printer. In the FIGURE, the electrophotographic photosensitive member 1, the charging unit 3, the developing unit 5, and the cleaning indicates 7 are integrally supported to form a cartridge, and this cartridge thus formed is used as a process cartridge 9 which is detachably mountable to a main body of an electrophotographic apparatus using a guide unit 10, such as rails, of the main body thereof.

EXAMPLES

Hereinafter, the present invention will be described in detail with reference to particular examples. However, the present invention is not limited thereto. In addition, "a part (or parts)" in the examples indicates "a part (or parts) by mass".

Example 1

An aluminum cylinder having a diameter of 30 mm and a length of 260.5 mm was used as a support.

Next, by using 10 parts of barium sulfate (conductive particles) processed by SnO2 coating, 2 parts of titanium oxide (pigment for resistance adjustment), 6 parts of a phenol resin (binding resin), 0.001 parts of a silicone oil (leveling agent), and a mixed solvent containing 4 parts of methanol and 16 parts of methoxy propanol, a conductive-layer coating liquid was prepared.

This conductive-layer coating liquid was applied on the support by immersion and was cured at 140° C. for 30 minutes, so that a conductive layer having a thickness of 15 was formed.

Next, an interlayer coating liquid was prepared by dissolving 3 parts of an N-methoxymethylized nylon and 3 parts of a copolyamide in a mixed solvent containing 65 parts of methanol and 30 parts of n-butanol.

This interlayer coating liquid was applied on the conductive layer by immersion and was then dried at 100° C. for 10 minutes, so that an interlayer having a thickness of 0.7 μm was formed.

Next, 10 parts of crystalline hydroxy gallium phthalocyanine (charge generation material) having strong peaks at 7.5°, 9.9°, 16.3°, 18.6°, 25.1°, and 28.3°, each corresponding to a Bragg angle of 2θ±0.2° in CuKα characteristics X-rays diffractometry, was added to a liquid in which 5 parts of a polyvinyl butyral resin (trade name: S-LEC BX-1 manufactured by Sekisui Chemical Co., Ltd., binding resin) was dissolved in 250 parts of cyclohexanone. The above charge generation material was dispersed in an atmosphere at 23° C.±3° C. for 1 hour by a sand mill device using glass beads having a diameter of 1 mm. After the dispersion treatment was finished, 250 parts of ethyl acetate was added to a dispersion thus obtained, so that a charge generation-layer coating liquid was prepared.

This charge generation-layer coating liquid was applied on the interlayer by immersion and was then dried at 100° C. for 10 minutes, so that a charge generation layer having a thickness of 0.26 μm was formed.

Next, 8 parts of a compound (charge transport material) represented by the following formula (CTM-1), 2 parts of a compound represented by the following formula (CTM-2), 3 parts of the polycarbonate resin A (1) synthesized in Synthetic Example 1, and 7 parts of a polyester resin C (1) (the molar ratio of p-phenylene to m-phenylene: 5:5, and the weight average molecular weight: 120,000) having a repeating structural unit represented by the above formula (4-1) were dissolved in a mixed solvent containing 20 parts of dimethoxymethane and 60 parts of xylene, so that the charge transport-layer coating liquid was prepared.

[Chem. 25]

(CTM-1)

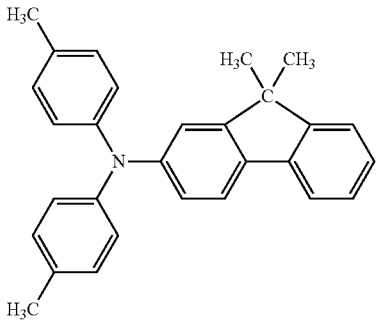

[Chem. 26]

(CTM-2)

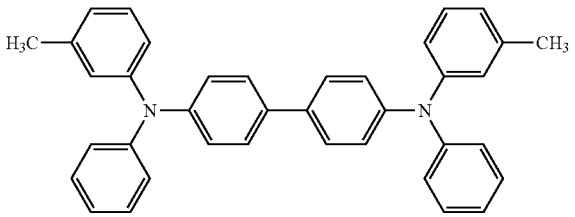

This charge transport-layer coating liquid was applied on the charge generation layer by immersion and was then dried at 120° C. for 1 hour, so that a charge transport layer having a thickness of 19 μm was formed. In the charge transport layer thus formed, it was confirmed that the domains formed from the polycarbonate resin A (1) were contained in the matrix formed from the charge transport material and the polyester resin C (1).

As described above, an electrophotographic photosensitive member which had the charge transport layer functioning as a surface layer was formed. The compositions of the resins contained in the charge transport layer and the content of the siloxane moiety contained therein are shown in Table 3.

Next, the evaluation will be described.

The evaluation was performed using the change in light portion potential (potential variation) after a repeated use of 2,000 sheets, the relative value of initial torque and that of torque after a repeated use of 2,000 sheets, and the observation of the surface of the electrophotographic photosensitive member when the torque was measured.

As an evaluation apparatus, a laser beam printer LBP-2510 manufactured by CANON KABUSHIKI KAISHA (charge (primary charge): contact charge system, process speed: 94.2 mm/s) was used after modification so that the charge potential (dark portion potential) of the electrophotographic photosensitive member could be adjusted. In addition, a cleaning blade made of a polyurethane rubber was set to the surface of the electrophotographic photosensitive member at a contact angle of 25° and a contact pressure of 35 g/cm.

The evaluation was performed in an atmosphere at a temperature of 23° C. and a relative humidity of 50%.

Evaluation of Potential Variation

The exposure amount (image exposure amount) of a 780-nm laser light source of the evaluation apparatus was set so that the light intensity at the surface of the electrophotographic photosensitive member was 0.3 μJ/cm$^2$. After a jig fixed so that a potential measuring probe was placed at a position 130 mm apart from the end of the electrophotographic photosensitive member was provided instead of a developing device, the measurement of the surface potential (dark portion potential and light portion potential) of the electrophotographic photosensitive member was performed at the position of the developing device. After the dark portion potential of a non-exposed area of the electrophotographic photosensitive member was set to −450 V, the light portion potential, which was light-attenuated from the dark portion potential by irradiation with laser beams, was measured. In addition, using A4 size regular paper, an image was successively outputted on 2,000 sheets, and the amount of change in light portion potential before and after the output was evaluated. A test chart having a print ratio of 5% was used for this evaluation. The results are shown in the column of potential variation in Table 7.

Evaluation of Relative Value of Torque

Under the same conditions as those of the potential variation evaluation, a drive current value (current value A) of a rotary motor of the electrophotographic photosensitive member was measured. This evaluation was performed to evaluate the amount of contact stress generated between the electrophotographic photosensitive member and the cleaning blade. A measured current value indicates the amount of the contact stress between the electrophotographic photosensitive member and the cleaning blade.

Furthermore, an electrophotographic photosensitive member, which was to be used as the control to obtain a relative value of torque, was formed by the following method.

Except that the polyester resin C (1) described above was used instead of the polycarbonate resin A (1) used for the charge transport layer of the electrophotographic photosensitive member of Example 1, an electrophotographic photosensitive member was formed in a manner as that of Example 1, and this member thus formed was used as a control electrophotographic photosensitive member.

By using the control electrophotographic photosensitive member thus formed, a drive current value (current value B) of a rotary motor thereof was measured in a manner similar to that in Example 1.

Thus, the ratio of the drive current value (current value A) of the electrophotographic photosensitive member using the polycarbonate resin A thus obtained to the drive current value (current value B) of the rotary motor of the electrophotographic photosensitive member using no polycarbonate resin A was calculated. The obtained (current value A)/(current value B) value was evaluated as the relative value of torque. This numerical value of the relative value of torque indicates an increase/decrease of the amount of contact stress between the electrophotographic photosensitive member and the cleaning blade, and a smaller numerical value of the relative value of torque indicates a smaller amount of contact stress between the electrophotographic photosensitive member and the cleaning blade. The results are shown in the column of relative value of initial torque in Table 7.

Next, by using regular paper having an A4 size, an image was successively outputted on 2,000 sheets. A test chart having a print ratio of 5% was used. Subsequently, the relative value of torque after a repeated use of 2,000 sheets was measured. The relative value of torque after a repeated use of 2,000 sheets was evaluated in a manner similar to that of the relative value of initial torque. In this case, 2,000 sheets were repeatedly used on the control electrophotographic photosensitive member, and by using a drive current value obtained at this stage, the relative value of torque after a repeated use of 2,000 sheets was calculated. The results are shown in the column of relative value of torque after a repeated use of 2,000 sheets in Table 7.

Evaluation of Matrix-Domain Structure

By using the electrophotographic photosensitive member formed by the method described above, a cross-section obtained by cutting the charge transport layer in a vertical direction thereof was observed using an ultra-depth profile measuring microscope VK-9500 (manufactured by Keyence Corporation). In this case, the magnification of an objective lens was set at 50 times and a region of 100 μm by 100 μm (10,000 $\mu m^2$) of the surface of the electrophotographic photosensitive member was used as a field of vision for observation. The maximum diameters of 100 domain portions which were randomly selected from these present in the field of vision were measured. The maximum diameters thus obtained were averaged and used as the number average particle diameter. The results are shown in Table 7.

Examples 2-68 and 101-168, and Comparative Examples 1-13, 16-19, 101-113, and 116-119

Except that the resins used in Example 1 for the charge transport layer were changed as shown in Table 3, 4, 5, or 6, electrophotographic photosensitive members were formed and evaluated in a manner similar to that in Example 1. In the charge transport layer of the electrophotographic photosensitive member of each of Examples 2 to 68 and 101 to 168, it was confirmed that the domains formed from the polycarbonate resin A were contained in the matrix formed from the charge transport material and the polyester resin C and/or the polycarbonate resin D. In the charge transport layer of the electrophotographic photosensitive member of each of Comparative Examples 5, 17, 105, and 117, it was confirmed that the domains formed from the polycarbonate resin A (28) or A (128) were contained in the matrix formed from the charge transport material and the polyester resin C or the polycarbonate resin D (5). In the charge transport layer of the electrophotographic photosensitive member of each of Comparative Examples 8, 18, 108, and 118, although it was confirmed that the domains formed from the polycarbonate resin A (30) or A (130) were contained in the matrix formed from the charge transport material and the polyester resin C (4) or the polycarbonate resin D (5), the domains were non-uniform. In the charge transport layer of the electrophotographic photosensitive member of each of Comparative Examples 11, 19, 111, and 119, it was confirmed that the domains formed from the polycarbonate resin A (32) or A (132) were contained in the matrix formed from the charge transport material and the polyester resin C (4) or the polycarbonate resin D (5). As the electrophotographic photosensitive member used as the control of the relative value of torque, an electrophotographic photosensitive member was used in which only at least one resin shown in Table 3 other than the RESIN A was used as the resin in the corresponding charge transport layer. The results are shown in Tables 7 and 8.

Examples 69, 70, 169, and 170

Except that the charge transport material used in Example 1 for the charge transport layer was changed from 8 parts of the compound represented by the above formula (CTM-1) and 2 parts of the compound represented by the above formula (CTM-2) to 8 parts of the compound represented by the above formula (CTM-1) and 2 parts of a compound represented by the following formula (CTM-3) and that the resins were changed to those shown in Table 3 or 6, electrophotographic photosensitive members were formed and evaluated in a manner similar to that in Example 1. In the charge transport layer of the electrophotographic photosensitive member of each of Examples 69, 70, 169, and 170, it was confirmed that the domains formed from the polycarbonate resin A were contained in the matrix formed from the charge transport material and the polyester resin C or the polycarbonate resin D. The results are shown in Tables 7 and 8.

[Chem. 27]

(CTM-3)

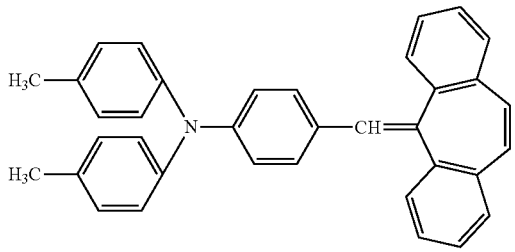

Examples 71 and 171

Except that the charge transport material used in Example 1 for the charge transport layer was changed from 8 parts of the compound represented by the above formula (CTM-1) and 2 parts of the compound represented by the above formula (CTM-2) to 10 parts of a compound represented by the following formula (CTM-4) and that the resins were changed to those shown in Table 3 or 5, electrophotographic photosensitive members were formed and evaluated in a manner similar to that in Example 1. In the charge transport layer of the electrophotographic photosensitive member of each of Examples 71 and 171, it was confirmed that the domains formed from the polycarbonate resin A were contained in the matrix formed from the charge transport material and the polycarbonate resin D. The results are shown in Tables 7 and 8.

[Chem. 28]

(CTM-4)

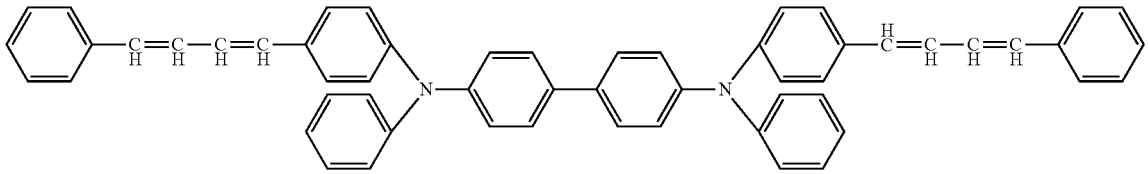

Examples 72 and 172

Except that the charge transport material used in Example 1 for the charge transport layer was changed from 8 parts of the compound represented by the above formula (CTM-1) and 2 parts of the compound represented by the above formula (CTM-2) to 10 parts of a compound represented by the following formula (CTM-5) and that the resins were changed to those shown in Table 3 or 5, electrophotographic photosensitive members were formed and evaluated in a manner similar to that in Example 1. In the charge transport layer of the electrophotographic photosensitive member of each of Examples 72 and 172, it was confirmed that the domains formed from the polycarbonate resin A were contained in the matrix formed from the charge transport material and the polycarbonate resin D. The results are shown in Tables 7 and 8.

[Chem. 29]

(CTM-5)

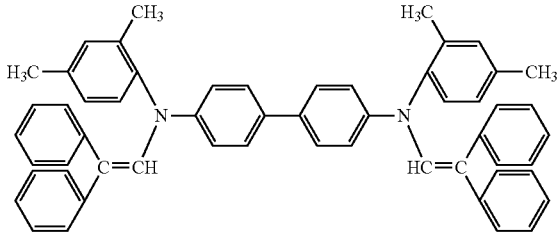

Comparative Example 14

Except that in Example 1, the above polycarbonate resin A (1) was changed to a polyester resin (H) (weight average molecular weight: 120,000) which had a structural unit represented by the above formula (4-4) and a terminal structure represented by the above formula (H) and in which the content of a siloxane moiety in the resin was 20 percent by mass, an electrophotographic photosensitive member was formed and evaluated in a manner similar to that in Example 1. The results are shown in Table 7.

Comparative Example 15

A process from the start to the formation of the charge generation layer was performed in a manner similar to that in Example 1.

Next, 8 parts of the compound represented by the above formula (CTM-1) (charge transport material), 2 parts of the compound represented by the above formula (CTM-2) (charge transport material), 9.9 parts of the polyester resin C (4) shown in Table 4, and 0.1 parts of methylphenylpolysiloxane were dissolved in a mixed solution of 20 parts of dimethoxymethane and 60 parts of chlorobenzene, so that a charge transport-layer coating liquid was prepared.

This charge transport-layer coating liquid was applied on the charge generation layer by immersion and was then dried at 120° C. for 1 hour, so that a charge transport layer having a thickness of 19 μm was formed. As described above, an electrophotographic photosensitive member having the charge transport layer which was a surface layer was formed. In the charge transport layer of the electrophotographic photosensitive member of Comparative Example 15, it was confirmed that the domains formed from methylphenylpolysiloxane were contained in the matrix formed from the charge transport material and the polyester resin C (4).

Evaluation was performed in a manner similar to that in Example 1. The results are shown in Table 7.

TABLE 3

| | RESIN A | MASS RATIO A OF SILOXANE (PERCENT BY MASS) | RESIN B |
|---|---|---|---|
| EXAMPLE 1 | POLYCARBONATE RESIN A(1) | 21 | POLYESTER RESIN C(1) |
| EXAMPLE 2 | POLYCARBONATE RESIN A(1) | 21 | POLYESTER RESIN C(1) |
| EXAMPLE 3 | POLYCARBONATE RESIN A(1) | 21 | POLYESTER RESIN C(1) |
| EXAMPLE 4 | POLYCARBONATE RESIN A(2) | 30 | POLYESTER RESIN C(5) |
| EXAMPLE 5 | POLYCARBONATE RESIN A(4) | 15 | POLYESTER RESIN C(6) |
| EXAMPLE 6 | POLYCARBONATE RESIN A(5) | 10 | POLYESTER RESIN C(3) |
| EXAMPLE 7 | POLYCARBONATE RESIN A(6) | 15 | POLYESTER RESIN C(3) |
| EXAMPLE 8 | POLYCARBONATE RESIN A(7) | 10 | POLYESTER RESIN C(1) |
| EXAMPLE 9 | POLYCARBONATE RESIN A(8) | 10 | POLYESTER RESIN C(3) |
| EXAMPLE 10 | POLYCARBONATE RESIN A(9) | 40 | POLYESTER RESIN C(3) |

TABLE 3-continued

| | | | |
|---|---|---|---|
| EXAMPLE 11 | POLYCARBONATE RESIN A(11) | 35 | POLYESTER RESIN C(7) |
| EXAMPLE 12 | POLYCARBONATE RESIN A(12) | 40 | POLYESTER RESIN C(7) |
| EXAMPLE 13 | POLYCARBONATE RESIN A(9) | 40 | POLYESTER RESIN C(8) |
| EXAMPLE 14 | POLYCARBONATE RESIN A(10) | 40 | POLYESTER RESIN C(8) |
| EXAMPLE 15 | POLYCARBONATE RESIN A(10) | 40 | POLYESTER RESIN C(8) |
| EXAMPLE 16 | POLYCARBONATE RESIN A(11) | 35 | POLYESTER RESIN C(4) |
| EXAMPLE 17 | POLYCARBONATE RESIN A(12) | 40 | POLYESTER RESIN C(1) |
| EXAMPLE 18 | POLYCARBONATE RESIN A(12) | 40 | POLYESTER RESIN C(1) |
| EXAMPLE 19 | POLYCARBONATE RESIN A(12) | 40 | POLYESTER RESIN C(2) |
| EXAMPLE 20 | POLYCARBONATE RESIN A(13) | 30 | POLYESTER RESIN C(1) |
| EXAMPLE 21 | POLYCARBONATE RESIN A(13) | 30 | POLYESTER RESIN C(1) |
| EXAMPLE 22 | POLYCARBONATE RESIN A(14) | 15 | POLYESTER RESIN C(1) |
| EXAMPLE 23 | POLYCARBONATE RESIN A(14) | 15 | POLYESTER RESIN C(1) |
| EXAMPLE 24 | POLYCARBONATE RESIN A(15) | 25 | POLYESTER RESIN C(1) |
| EXAMPLE 25 | POLYCARBONATE RESIN A(15) | 25 | POLYESTER RESIN C(1) |
| EXAMPLE 26 | POLYCARBONATE RESIN A(16) | 30 | POLYESTER RESIN C(9) |
| EXAMPLE 27 | POLYCARBONATE RESIN A(16) | 30 | POLYESTER RESIN C(9) |
| EXAMPLE 28 | POLYCARBONATE RESIN A(17) | 21 | POLYESTER RESIN C(10) |
| EXAMPLE 29 | POLYCARBONATE RESIN A(18) | 25 | POLYESTER RESIN C(11) |
| EXAMPLE 30 | POLYCARBONATE RESIN A(20) | 10 | POLYESTER RESIN C(1) |
| EXAMPLE 31 | POLYCARBONATE RESIN A(21) | 21 | POLYESTER RESIN C(1) |
| EXAMPLE 32 | POLYCARBONATE RESIN A(22) | 30 | POLYESTER RESIN C(12) |
| EXAMPLE 33 | POLYCARBONATE RESIN A(23) | 21 | POLYESTER RESIN C(13) |
| EXAMPLE 34 | POLYCARBONATE RESIN A(24) | 25 | POLYESTER RESIN C(14) |
| EXAMPLE 35 | POLYCARBONATE RESIN A(25) | 30 | POLYESTER RESIN C(15) |
| EXAMPLE 36 | POLYCARBONATE RESIN A(26) | 21 | POLYESTER RESIN C(16) |
| EXAMPLE 37 | POLYCARBONATE RESIN A(1) | 21 | POLYESTER RESIN C(1)/ POLYCARBONATE RESIN D(1) |
| EXAMPLE 38 | POLYCARBONATE RESIN A(1) | 21 | POLYCARBONATE RESIN D(1) |
| EXAMPLE 39 | POLYCARBONATE RESIN A(1) | 21 | POLYCARBONATE RESIN D(1) |
| EXAMPLE 40 | POLYCARBONATE RESIN A(1) | 21 | POLYCARBONATE RESIN D(1) |
| EXAMPLE 41 | POLYCARBONATE RESIN A(3) | 25 | POLYCARBONATE RESIN D(2) |
| EXAMPLE 42 | POLYCARBONATE RESIN A(7) | 10 | POLYCARBONATE RESIN D(3) |
| EXAMPLE 43 | POLYCARBONATE RESIN A(10) | 40 | POLYCARBONATE RESIN D(4) |
| EXAMPLE 44 | POLYCARBONATE RESIN A(8) | 10 | POLYCARBONATE RESIN D(3) |
| EXAMPLE 45 | POLYCARBONATE RESIN A(9) | 40 | POLYCARBONATE RESIN D(2) |
| EXAMPLE 46 | POLYCARBONATE RESIN A(11) | 35 | POLYCARBONATE RESIN D(4) |
| EXAMPLE 47 | POLYCARBONATE RESIN A(17) | 21 | POLYCARBONATE RESIN D(5) |
| EXAMPLE 48 | POLYCARBONATE RESIN A(19) | 21 | POLYCARBONATE RESIN D(6) |
| EXAMPLE 49 | POLYCARBONATE RESIN A(12) | 40 | POLYCARBONATE RESIN D(1) |
| EXAMPLE 50 | POLYCARBONATE RESIN A(35) | 25 | POLYESTER RESIN C(3) |
| EXAMPLE 51 | POLYCARBONATE RESIN A(35) | 25 | POLYCARBONATE RESIN D(1) |
| EXAMPLE 52 | POLYCARBONATE RESIN A(36) | 25 | POLYESTER RESIN C(3) |
| EXAMPLE 53 | POLYCARBONATE RESIN A(36) | 25 | POLYCARBONATE RESIN D(1) |
| EXAMPLE 54 | POLYCARBONATE RESIN A(37) | 25 | POLYESTER RESIN C(1) |
| EXAMPLE 55 | POLYCARBONATE RESIN A(37) | 25 | POLYCARBONATE RESIN D(1) |
| EXAMPLE 56 | POLYCARBONATE RESIN A(38) | 20 | POLYCARBONATE RESIN D(1) |
| EXAMPLE 57 | POLYCARBONATE RESIN A(38) | 20 | POLYCARBONATE RESIN D(1) |
| EXAMPLE 58 | POLYCARBONATE RESIN A(38) | 20 | POLYCARBONATE RESIN D(1) |
| EXAMPLE 59 | POLYCARBONATE RESIN A(38) | 20 | POLYESTER RESIN C(1) |
| EXAMPLE 60 | POLYCARBONATE RESIN A(38) | 20 | POLYESTER RESIN C(1) |
| EXAMPLE 61 | POLYCARBONATE RESIN A(38) | 20 | POLYESTER RESIN C(1) |
| EXAMPLE 62 | POLYCARBONATE RESIN A(39) | 20 | POLYCARBONATE RESIN D(1) |
| EXAMPLE 63 | POLYCARBONATE RESIN A(39) | 20 | POLYESTER RESIN C(1) |
| EXAMPLE 64 | POLYCARBONATE RESIN A(40) | 20 | POLYCARBONATE RESIN D(1) |
| EXAMPLE 65 | POLYCARBONATE RESIN A(1) | 20 | POLYCARBONATE RESIN D(7) |
| EXAMPLE 66 | POLYCARBONATE RESIN A(1) | 20 | POLYCARBONATE RESIN D(8) |
| EXAMPLE 67 | POLYCARBONATE RESIN A(38) | 20 | POLYCARBONATE RESIN D(7) |
| EXAMPLE 68 | POLYCARBONATE RESIN A(38) | 20 | POLYCARBONATE RESIN D(8) |
| EXAMPLE 69 | POLYCARBONATE RESIN A(1) | 20 | POLYCARBONATE RESIN D(1) |
| EXAMPLE 70 | POLYCARBONATE RESIN A(1) | 20 | POLYESTER RESIN C(1) |
| EXAMPLE 71 | POLYCARBONATE RESIN A(1) | 20 | POLYCARBONATE RESIN D(1) |
| EXAMPLE 72 | POLYCARBONATE RESIN A(1) | 20 | POLYCARBONATE RESIN D(1) |

| | REPEATING STRUCTURAL UNIT OF RESIN B | m-PHENYLENE/ p-PHENYLENE | WEIGHT AVERAGE MOLECULAR WEIGHT OF RESIN B (Mw) | MIX RATIO OF RESIN A TO RESIN B (A/B) | MASS RATIO B OF SILOXANE (PERCENT BY MASS) |
|---|---|---|---|---|---|
| EXAMPLE 1 | (4-1) | 5/5 | 120000 | 3/7 | 6.3 |
| EXAMPLE 2 | (4-1) | 5/5 | 120000 | 4/6 | 8.4 |
| EXAMPLE 3 | (4-1) | 5/5 | 120000 | 1/9 | 2.1 |
| EXAMPLE 4 | (4-10) | — | 100000 | 2/8 | 6.0 |
| EXAMPLE 5 | (4-1)/ (4-7) = 7/3 | 5/5 | 120000 | 3/7 | 4.5 |
| EXAMPLE 6 | (4-2) | 5/5 | 130000 | 3/7 | 3.0 |
| EXAMPLE 7 | (4-2) | 5/5 | 80000 | 1/9 | 1.5 |

TABLE 3-continued

| | | | | | |
|---|---|---|---|---|---|
| EXAMPLE 8 | (4-1) | 5/5 | 120000 | 1/9 | 1.0 |
| EXAMPLE 9 | (4-2) | 5/5 | 80000 | 3/7 | 3.0 |
| EXAMPLE 10 | (4-2) | 5/5 | 130000 | 5/5 | 20.0 |
| EXAMPLE 11 | (4-9) | — | 120000 | 3/7 | 10.5 |
| EXAMPLE 12 | (4-9) | — | 100000 | 6/4 | 24.0 |
| EXAMPLE 13 | (4-4) | 5/5 | 90000 | 4/6 | 16.0 |
| EXAMPLE 14 | (4-4) | 5/5 | 120000 | 4/6 | 16.0 |
| EXAMPLE 15 | (4-4) | 5/5 | 100000 | 2/8 | 8.0 |
| EXAMPLE 16 | (4-3) | 5/5 | 120000 | 5/5 | 17.5 |
| EXAMPLE 17 | (4-1) | 5/5 | 70000 | 3/7 | 12.0 |
| EXAMPLE 18 | (4-1) | 5/5 | 150000 | 1/9 | 4.0 |
| EXAMPLE 19 | (4-8) | — | 90000 | 3/7 | 12.0 |
| EXAMPLE 20 | (4-1) | 5/5 | 70000 | 3/7 | 9.0 |
| EXAMPLE 21 | (4-1) | 5/5 | 70000 | 1/9 | 3.0 |
| EXAMPLE 22 | (4-1) | 5/5 | 150000 | 3/7 | 4.5 |
| EXAMPLE 23 | (4-6) | 5/5 | 90000 | 1/9 | 1.5 |
| EXAMPLE 24 | (4-7) | — | 100000 | 4/6 | 10.0 |
| EXAMPLE 25 | (4-8) | — | 120000 | 2/8 | 5.0 |
| EXAMPLE 26 | (4-11) | — | 90000 | 4/6 | 12.0 |
| EXAMPLE 27 | (4-11) | — | 100000 | 2/8 | 6.0 |
| EXAMPLE 28 | (4-14) | — | 90000 | 3/7 | 6.3 |
| EXAMPLE 29 | (4-12) | — | 100000 | 3/7 | 7.5 |
| EXAMPLE 30 | (4-1) | 5/5 | 70000 | 3/7 | 3.0 |
| EXAMPLE 31 | (4-1) | 5/5 | 150000 | 3/7 | 6.3 |
| EXAMPLE 32 | (4-5) | 5/5 | 120000 | 4/6 | 12.0 |
| EXAMPLE 33 | (4-6) | 5/5 | 100000 | 4/6 | 8.4 |
| EXAMPLE 34 | (4-7) | — | 90000 | 4/6 | 10.0 |
| EXAMPLE 35 | (4-8) | — | 100000 | 4/6 | 12 |
| EXAMPLE 36 | (4-13) | — | 110000 | 3/7 | 6.3 |
| EXAMPLE 37 | (4-1)/ | 5/5 | 120000/ | 3/7 | 6.3 |
| | (5-4) = 5/5 | — | 30000 | | |
| EXAMPLE 38 | (5-4) | — | 30000 | 3/7 | 6.3 |
| EXAMPLE 39 | (5-4) | — | 60000 | 4/6 | 8.4 |
| EXAMPLE 40 | (5-4) | — | 80000 | 1/9 | 2.1 |
| EXAMPLE 41 | (5-5) | — | 30000 | 5/5 | 12.5 |
| EXAMPLE 42 | (5-2) | — | 30000 | 3/7 | 3.0 |
| EXAMPLE 43 | (5-3) | — | 27000 | 3/7 | 12.0 |
| EXAMPLE 44 | (5-2) | — | 30000 | 1/9 | 1.0 |
| EXAMPLE 45 | (5-5) | — | 30000 | 4/6 | 16.0 |
| EXAMPLE 46 | (5-3) | — | 30000 | 3/7 | 10.5 |
| EXAMPLE 47 | (5-1) | — | 30000 | 3/7 | 6.3 |
| EXAMPLE 48 | (5-6) | — | 30000 | 3/7 | 6.3 |
| EXAMPLE 49 | (5-4) | — | 50000 | 2/8 | 8.0 |
| EXAMPLE 50 | (4-2) | 5/5 | 100000 | 3/7 | 7.5 |
| EXAMPLE 51 | (5-4) | — | 30000 | 3/7 | 7.5 |
| EXAMPLE 52 | (4-2) | 5/5 | 100000 | 3/7 | 7.5 |
| EXAMPLE 53 | (5-4) | — | 30000 | 3/7 | 7.5 |
| EXAMPLE 54 | (4-1) | 5/5 | 120000 | 3/7 | 7.5 |
| EXAMPLE 55 | (5-4) | — | 30000 | 3/7 | 7.5 |
| EXAMPLE 56 | (5-4) | — | 30000 | 3/7 | 6.0 |
| EXAMPLE 57 | (5-4) | — | 30000 | 1/9 | 2.0 |
| EXAMPLE 58 | (5-4) | — | 30000 | 5/5 | 10.0 |
| EXAMPLE 59 | (4-1) | 5/5 | 120000 | 3/7 | 6.0 |
| EXAMPLE 60 | (4-1) | 5/5 | 120000 | 1/9 | 2.0 |
| EXAMPLE 61 | (4-1) | 5/5 | 120000 | 5/5 | 10.0 |
| EXAMPLE 62 | (5-4) | — | 30000 | 3/7 | 6.0 |
| EXAMPLE 63 | (4-1) | 5/5 | 120000 | 3/7 | 6.0 |
| EXAMPLE 64 | (5-4) | — | 30000 | 3/7 | 6.0 |
| EXAMPLE 65 | (3-1)/ | — | 60000 | 3/7 | 6.0 |
| | (3-5) = 8/2 | | | | |
| EXAMPLE 66 | (3-1)/ | — | 50000 | 3/7 | 6.0 |
| | (3-6) = 5/5 | | | | |
| EXAMPLE 67 | (3-1)/ | — | 60000 | 3/7 | 6.0 |
| | (3-5) = 8/2 | | | | |
| EXAMPLE 68 | (3-1)/ | — | 50000 | 3/7 | 6.0 |
| | (3-6) = 5/5 | | | | |
| EXAMPLE 69 | (5-4) | — | 30000 | 3/7 | 6.0 |
| EXAMPLE 70 | (4-1) | 5/5 | 120000 | 3/7 | 6.0 |
| EXAMPLE 71 | (5-4) | — | 30000 | 3/7 | 6.0 |
| EXAMPLE 72 | (5-4) | — | 30000 | 3/7 | 6.0 |

TABLE 4

| | RESIN A | MASS RATIO A OF SILOXANE (PERCENT BY MASS) | RESIN B |
|---|---|---|---|
| COMPARATIVE EXAMPLE 1 | POLYCARBONATE RESIN A(27) | 8 | — |
| COMPARATIVE EXAMPLE 2 | POLYCARBONATE RESIN A(27) | 8 | POLYESTER RESIN C(4) |
| COMPARATIVE EXAMPLE 3 | POLYCARBONATE RESIN A(27) | 8 | POLYCARBONATE RESIN D(5) |
| COMPARATIVE EXAMPLE 4 | POLYCARBONATE RESIN A(28) | 50 | — |
| COMPARATIVE EXAMPLE 5 | POLYCARBONATE RESIN A(28) | 50 | POLYESTER RESIN C(4) |
| COMPARATIVE EXAMPLE 6 | POLYCARBONATE RESIN A(29) | 30 | POLYESTER RESIN C(4) |
| COMPARATIVE EXAMPLE 7 | POLYCARBONATE RESIN A(29) | 30 | POLYCARBONATE RESIN D(5) |
| COMPARATIVE EXAMPLE 8 | POLYCARBONATE RESIN A(30) | 25 | POLYESTER RESIN C(4) |
| COMPARATIVE EXAMPLE 9 | POLYCARBONATE RESIN A(31) | 30 | POLYESTER RESIN C(4) |
| COMPARATIVE EXAMPLE 10 | POLYCARBONATE RESIN A(31) | 30 | POLYCARBONATE RESIN D(4) |
| COMPARATIVE EXAMPLE 11 | POLYCARBONATE RESIN A(32) | 20 | POLYESTER RESIN C(4) |
| COMPARATIVE EXAMPLE 12 | POLYCARBONATE RESIN A(33) | 8 | POLYESTER RESIN C(4) |
| COMPARATIVE EXAMPLE 13 | POLYCARBONATE RESIN A(34) | 30 | POLYESTER RESIN C(4) |
| COMPARATIVE EXAMPLE 14 | POLYESTER RESIN(J) | 20 | POLYESTER RESIN C(4) |
| COMPARATIVE EXAMPLE 15 | METHYLPHENYLPOLYSILOXANE | 100 | POLYESTER RESIN C(4) |
| COMPARATIVE EXAMPLE 16 | POLYCARBONATE RESIN A(22) | 30 | — |
| COMPARATIVE EXAMPLE 17 | POLYCARBONATE RESIN A(28) | 50 | POLYCARBONATE RESIN D(5) |
| COMPARATIVE EXAMPLE 18 | POLYCARBONATE RESIN A(30) | 25 | POLYCARBONATE RESIN D(5) |
| COMPARATIVE EXAMPLE 19 | POLYCARBONATE RESIN A(32) | 20 | POLYCARBONATE RESIN D(5) |

| | REPEATING STRUCTURAL UNIT OF RESIN B | m-PHENYLENE/ p-PHENYLENE | WEIGHT AVERAGE MOLECULAR WEIGHT OF RESIN B (Mw) | MIX RATIO OF RESIN A TO RESIN B (A/B) | MASS RATIO B OF SILOXANE (PERCENT BY MASS) |
|---|---|---|---|---|---|
| COMPARATIVE EXAMPLE 1 | — | — | — | — | 8.0 |
| COMPARATIVE EXAMPLE 2 | (4-3) | 5/5 | 120000 | 1/9 | 0.8 |
| COMPARATIVE EXAMPLE 3 | (5-1) | — | 20000 | 3/7 | 2.4 |
| COMPARATIVE EXAMPLE 4 | — | — | — | — | 50.0 |
| COMPARATIVE EXAMPLE 5 | (4-3) | 5/5 | 120000 | 3/7 | 15.0 |
| COMPARATIVE EXAMPLE 6 | (4-3) | 5/5 | 120000 | 3/7 | 9.0 |
| COMPARATIVE EXAMPLE 7 | (5-1) | — | 60000 | 3/7 | 9.0 |
| COMPARATIVE EXAMPLE 8 | (4-3) | 5/5 | 120000 | 3/7 | 7.5 |
| COMPARATIVE EXAMPLE 9 | (4-3) | 5/5 | 120000 | 3/7 | 9.0 |
| COMPARATIVE EXAMPLE 10 | (5-3) | — | 50000 | 3/7 | 9.0 |
| COMPARATIVE EXAMPLE 11 | (4-3) | 5/5 | 120000 | 3/7 | 10.0 |
| COMPARATIVE EXAMPLE 12 | (4-3) | 5/5 | 120000 | 2/8 | 1.6 |
| COMPARATIVE EXAMPLE 13 | (4-3) | 5/5 | 120000 | 3/7 | 9.0 |

TABLE 4-continued

| | | | | | |
|---|---|---|---|---|---|
| COMPARATIVE EXAMPLE 14 | (4-3) | 5/5 | 120000 | 3/7 | 6.0 |
| COMPARATIVE EXAMPLE 15 | (4-3) | 5/5 | 120000 | 1/99 | 1.0 |
| COMPARATIVE EXAMPLE 16 | — | — | — | — | 30.0 |
| COMPARATIVE EXAMPLE 17 | (5-1) | — | 60000 | 3/7 | 15.0 |
| COMPARATIVE EXAMPLE 18 | (5-1) | — | 60000 | 3/7 | 7.5 |
| COMPARATIVE EXAMPLE 19 | (5-1) | — | 60000 | 3/7 | 10.0 |

TABLE 5

| | RESIN A | MASS RATIO A OF SILOXANE (PERCENT BY MASS) | RESIN B |
|---|---|---|---|
| EXAMPLE 101 | POLYCARBONATE RESIN A(101) | 21 | POLYESTER RESIN C(1) |
| EXAMPLE 102 | POLYCARBONATE RESIN A(101) | 21 | POLYESTER RESIN C(1) |
| EXAMPLE 103 | POLYCARBONATE RESIN A(101) | 21 | POLYESTER RESIN C(1) |
| EXAMPLE 104 | POLYCARBONATE RESIN A(102) | 30 | POLYESTER RESIN C(5) |
| EXAMPLE 105 | POLYCARBONATE RESIN A(104) | 15 | POLYESTER RESIN C(6) |
| EXAMPLE 106 | POLYCARBONATE RESIN A(105) | 10 | POLYESTER RESIN C(3) |
| EXAMPLE 107 | POLYCARBONATE RESIN A(106) | 15 | POLYESTER RESIN C(3) |
| EXAMPLE 108 | POLYCARBONATE RESIN A(107) | 10 | POLYESTER RESIN C(1) |
| EXAMPLE 109 | POLYCARBONATE RESIN A(108) | 10 | POLYESTER RESIN C(3) |
| EXAMPLE 110 | POLYCARBONATE RESIN A(109) | 40 | POLYESTER RESIN C(3) |
| EXAMPLE 111 | POLYCARBONATE RESIN A(111) | 35 | POLYESTER RESIN C(7) |
| EXAMPLE 112 | POLYCARBONATE RESIN A(112) | 40 | POLYESTER RESIN C(7) |
| EXAMPLE 113 | POLYCARBONATE RESIN A(109) | 40 | POLYESTER RESIN C(8) |
| EXAMPLE 114 | POLYCARBONATE RESIN A(110) | 40 | POLYESTER RESIN C(8) |
| EXAMPLE 115 | POLYCARBONATE RESIN A(110) | 40 | POLYESTER RESIN C(8) |
| EXAMPLE 116 | POLYCARBONATE RESIN A(111) | 35 | POLYESTER RESIN C(4) |
| EXAMPLE 117 | POLYCARBONATE RESIN A(112) | 40 | POLYESTER RESIN C(1) |
| EXAMPLE 118 | POLYCARBONATE RESIN A(112) | 40 | POLYESTER RESIN C(1) |
| EXAMPLE 119 | POLYCARBONATE RESIN A(112) | 40 | POLYESTER RESIN C(2) |
| EXAMPLE 120 | POLYCARBONATE RESIN A(113) | 30 | POLYESTER RESIN C(1) |
| EXAMPLE 121 | POLYCARBONATE RESIN A(113) | 30 | POLYESTER RESIN C(1) |
| EXAMPLE 122 | POLYCARBONATE RESIN A(114) | 15 | POLYESTER RESIN C(1) |
| EXAMPLE 123 | POLYCARBONATE RESIN A(114) | 15 | POLYESTER RESIN C(1) |
| EXAMPLE 124 | POLYCARBONATE RESIN A(115) | 25 | POLYESTER RESIN C(1) |
| EXAMPLE 125 | POLYCARBONATE RESIN A(115) | 25 | POLYESTER RESIN C(1) |
| EXAMPLE 126 | POLYCARBONATE RESIN A(116) | 30 | POLYESTER RESIN C(9) |
| EXAMPLE 127 | POLYCARBONATE RESIN A(116) | 30 | POLYESTER RESIN C(9) |
| EXAMPLE 128 | POLYCARBONATE RESIN A(117) | 21 | POLYESTER RESIN C(10) |
| EXAMPLE 129 | POLYCARBONATE RESIN A(118) | 25 | POLYESTER RESIN C(11) |
| EXAMPLE 130 | POLYCARBONATE RESIN A(120) | 10 | POLYESTER RESIN C(1) |
| EXAMPLE 131 | POLYCARBONATE RESIN A(121) | 21 | POLYESTER RESIN C(1) |
| EXAMPLE 132 | POLYCARBONATE RESIN A(122) | 30 | POLYESTER RESIN C(12) |
| EXAMPLE 133 | POLYCARBONATE RESIN A(123) | 21 | POLYESTER RESIN C(13) |
| EXAMPLE 134 | POLYCARBONATE RESIN A(124) | 25 | POLYESTER RESIN C(14) |
| EXAMPLE 135 | POLYCARBONATE RESIN A(125) | 30 | POLYESTER RESIN C(15) |
| EXAMPLE 136 | POLYCARBONATE RESIN A(126) | 21 | POLYESTER RESIN C(16) |
| EXAMPLE 137 | POLYCARBONATE RESIN A(101) | 21 | POLYESTER RESIN C(1)/ POLYCARBONATE RESIN D(1) |
| EXAMPLE 138 | POLYCARBONATE RESIN A(101) | 21 | POLYCARBONATE RESIN D(1) |
| EXAMPLE 139 | POLYCARBONATE RESIN A(101) | 21 | POLYCARBONATE RESIN D(1) |
| EXAMPLE 140 | POLYCARBONATE RESIN A(101) | 21 | POLYCARBONATE RESIN D(1) |
| EXAMPLE 141 | POLYCARBONATE RESIN A(103) | 25 | POLYCARBONATE RESIN D(2) |
| EXAMPLE 142 | POLYCARBONATE RESIN A(107) | 10 | POLYCARBONATE RESIN D(3) |
| EXAMPLE 143 | POLYCARBONATE RESIN A(110) | 40 | POLYCARBONATE RESIN D(4) |
| EXAMPLE 144 | POLYCARBONATE RESIN A(108) | 10 | POLYCARBONATE RESIN D(3) |
| EXAMPLE 145 | POLYCARBONATE RESIN A(109) | 40 | POLYCARBONATE RESIN D(2) |
| EXAMPLE 146 | POLYCARBONATE RESIN A(111) | 35 | POLYCARBONATE RESIN D(4) |
| EXAMPLE 147 | POLYCARBONATE RESIN A(117) | 21 | POLYCARBONATE RESIN D(5) |
| EXAMPLE 148 | POLYCARBONATE RESIN A(119) | 21 | POLYCARBONATE RESIN D(6) |
| EXAMPLE 149 | POLYCARBONATE RESIN A(112) | 40 | POLYCARBONATE RESIN D(1) |
| EXAMPLE 150 | POLYCARBONATE RESIN A(135) | 25 | POLYESTER RESIN C(3) |
| EXAMPLE 151 | POLYCARBONATE RESIN A(135) | 25 | POLYCARBONATE RESIN D(1) |
| EXAMPLE 152 | POLYCARBONATE RESIN A(136) | 25 | POLYESTER RESIN C(3) |
| EXAMPLE 153 | POLYCARBONATE RESIN A(136) | 25 | POLYCARBONATE RESIN D(1) |
| EXAMPLE 154 | POLYCARBONATE RESIN A(137) | 25 | POLYESTER RESIN C(1) |

TABLE 5-continued

| | | | |
|---|---|---|---|
| EXAMPLE 155 | POLYCARBONATE RESIN A(137) | 25 | POLYCARBONATE RESIN D(1) |
| EXAMPLE 156 | POLYCARBONATE RESIN A(138) | 20 | POLYCARBONATE RESIN D(1) |
| EXAMPLE 157 | POLYCARBONATE RESIN A(138) | 20 | POLYCARBONATE RESIN D(1) |
| EXAMPLE 158 | POLYCARBONATE RESIN A(138) | 20 | POLYCARBONATE RESIN D(1) |
| EXAMPLE 159 | POLYCARBONATE RESIN A(138) | 20 | POLYESTER RESIN C(1) |
| EXAMPLE 160 | POLYCARBONATE RESIN A(138) | 20 | POLYESTER RESIN C(1) |
| EXAMPLE 161 | POLYCARBONATE RESIN A(138) | 20 | POLYESTER RESIN C(1) |
| EXAMPLE 162 | POLYCARBONATE RESIN A(139) | 20 | POLYCARBONATE RESIN D(1) |
| EXAMPLE 163 | POLYCARBONATE RESIN A(139) | 20 | POLYESTER RESIN C(1) |
| EXAMPLE 164 | POLYCARBONATE RESIN A(140) | 20 | POLYCARBONATE RESIN D(1) |
| EXAMPLE 165 | POLYCARBONATE RESIN A(101) | 20 | POLYCARBONATE RESIN D(7) |
| EXAMPLE 166 | POLYCARBONATE RESIN A(101) | 20 | POLYCARBONATE RESIN D(8) |
| EXAMPLE 167 | POLYCARBONATE RESIN A(138) | 20 | POLYCARBONATE RESIN D(7) |
| EXAMPLE 168 | POLYCARBONATE RESIN A(138) | 20 | POLYCARBONATE RESIN D(8) |
| EXAMPLE 169 | POLYCARBONATE RESIN A(101) | 20 | POLYCARBONATE RESIN D(1) |
| EXAMPLE 170 | POLYCARBONATE RESIN A(101) | 20 | POLYESTER RESIN C(1) |
| EXAMPLE 171 | POLYCARBONATE RESIN A(101) | 20 | POLYCARBONATE RESIN D(1) |
| EXAMPLE 172 | POLYCARBONATE RESIN A(101) | 20 | POLYCARBONATE RESIN D(1) |

| | REPEATING STRUCTURAL UNIT OF RESIN B | m-PHENYLENE/ p-PHENYLENE | WEIGHT AVERAGE MOLECULAR WEIGHT OF RESIN B (Mw) | MIX RATIO OF RESIN A TO RESIN B (A/B) | MASS RATIO B OF SILOXANE (PERCENT BY MASS) |
|---|---|---|---|---|---|
| EXAMPLE 101 | (4-1) | 5/5 | 120000 | 3/7 | 6.3 |
| EXAMPLE 102 | (4-1) | 5/5 | 120000 | 4/6 | 8.4 |
| EXAMPLE 103 | (4-1) | 5/5 | 120000 | 1/9 | 2.1 |
| EXAMPLE 104 | (4-10) | — | 100000 | 2/8 | 6.0 |
| EXAMPLE 105 | (4-1)/ (4-7) = 7/3 | 5/5 | 120000 | 3/7 | 4.5 |
| EXAMPLE 106 | (4-2) | 5/5 | 130000 | 3/7 | 3.0 |
| EXAMPLE 107 | (4-2) | 5/5 | 80000 | 1/9 | 1.5 |
| EXAMPLE 108 | (4-1) | 5/5 | 120000 | 1/9 | 1.0 |
| EXAMPLE 109 | (4-2) | 5/5 | 80000 | 3/7 | 3.0 |
| EXAMPLE 110 | (4-2) | 5/5 | 130000 | 5/5 | 20.0 |
| EXAMPLE 111 | (4-9) | — | 120000 | 3/7 | 10.5 |
| EXAMPLE 112 | (4-9) | — | 100000 | 6/4 | 24.0 |
| EXAMPLE 113 | (4-4) | 5/5 | 90000 | 4/6 | 16.0 |
| EXAMPLE 114 | (4-4) | 5/5 | 120000 | 4/6 | 16.0 |
| EXAMPLE 115 | (4-4) | 5/5 | 100000 | 2/8 | 8.0 |
| EXAMPLE 116 | (4-3) | 5/5 | 120000 | 5/5 | 17.5 |
| EXAMPLE 117 | (4-1) | 5/5 | 70000 | 3/7 | 12.0 |
| EXAMPLE 118 | (4-1) | 5/5 | 150000 | 1/9 | 4.0 |
| EXAMPLE 119 | (4-8) | — | 90000 | 3/7 | 12.0 |
| EXAMPLE 120 | (4-1) | 5/5 | 70000 | 3/7 | 9.0 |
| EXAMPLE 121 | (4-1) | 5/5 | 70000 | 1/9 | 3.0 |
| EXAMPLE 122 | (4-1) | 5/5 | 150000 | 3/7 | 4.5 |
| EXAMPLE 123 | (4-6) | 5/5 | 90000 | 1/9 | 1.5 |
| EXAMPLE 124 | (4-7) | — | 100000 | 4/6 | 10.0 |
| EXAMPLE 125 | (4-8) | — | 120000 | 2/8 | 5.0 |
| EXAMPLE 126 | (4-11) | — | 90000 | 4/6 | 12.0 |
| EXAMPLE 127 | (4-11) | — | 100000 | 2/8 | 6.0 |
| EXAMPLE 128 | (4-14) | — | 90000 | 3/7 | 6.3 |
| EXAMPLE 129 | (4-12) | — | 100000 | 3/7 | 7.5 |
| EXAMPLE 130 | (4-1) | 5/5 | 70000 | 3/7 | 3.0 |
| EXAMPLE 131 | (4-1) | 5/5 | 150000 | 3/7 | 6.3 |
| EXAMPLE 132 | (4-5) | 5/5 | 120000 | 4/6 | 12.0 |
| EXAMPLE 133 | (4-6) | 5/5 | 100000 | 4/6 | 8.4 |
| EXAMPLE 134 | (4-7) | — | 90000 | 4/6 | 10.0 |
| EXAMPLE 135 | (4-8) | — | 100000 | 4/6 | 12 |
| EXAMPLE 136 | (4-13) | — | 110000 | 3/7 | 6.3 |
| EXAMPLE 137 | (4-1)/ (5-4) = 5/5 | 5/5 — | 120000/ 30000 | 3/7 | 6.3 |
| EXAMPLE 138 | (5-4) | — | 30000 | 3/7 | 6.3 |
| EXAMPLE 139 | (5-4) | — | 60000 | 4/6 | 8.4 |
| EXAMPLE 140 | (5-4) | — | 80000 | 1/9 | 2.1 |
| EXAMPLE 141 | (5-5) | — | 30000 | 5/5 | 12.5 |
| EXAMPLE 142 | (5-2) | — | 30000 | 3/7 | 3.0 |
| EXAMPLE 143 | (5-3) | — | 27000 | 3/7 | 12.0 |
| EXAMPLE 144 | (5-2) | — | 30000 | 1/9 | 1.0 |
| EXAMPLE 145 | (5-5) | — | 30000 | 4/6 | 16.0 |
| EXAMPLE 146 | (5-3) | — | 30000 | 3/7 | 10.5 |
| EXAMPLE 147 | (5-1) | — | 30000 | 3/7 | 6.3 |
| EXAMPLE 148 | (5-6) | — | 30000 | 3/7 | 6.3 |
| EXAMPLE 149 | (5-4) | — | 50000 | 2/8 | 8.0 |
| EXAMPLE 150 | (4-2) | 5/5 | 100000 | 3/7 | 7.5 |
| EXAMPLE 151 | (5-4) | — | 30000 | 3/7 | 7.5 |

TABLE 5-continued

| | | | | | |
|---|---|---|---|---|---|
| EXAMPLE 152 | (4-2) | 5/5 | 100000 | 3/7 | 7.5 |
| EXAMPLE 153 | (5-4) | — | 30000 | 3/7 | 7.5 |
| EXAMPLE 154 | (4-1) | 5/5 | 120000 | 3/7 | 7.5 |
| EXAMPLE 155 | (5-4) | — | 30000 | 3/7 | 7.5 |
| EXAMPLE 156 | (5-4) | — | 30000 | 3/7 | 6.0 |
| EXAMPLE 157 | (5-4) | — | 30000 | 1/9 | 2.0 |
| EXAMPLE 158 | (5-4) | — | 30000 | 5/5 | 10.0 |
| EXAMPLE 159 | (4-1) | 5/5 | 120000 | 3/7 | 6.0 |
| EXAMPLE 160 | (4-1) | 5/5 | 120000 | 1/9 | 2.0 |
| EXAMPLE 161 | (4-1) | 5/5 | 120000 | 5/5 | 10.0 |
| EXAMPLE 162 | (5-4) | — | 30000 | 3/7 | 6.0 |
| EXAMPLE 163 | (4-1) | 5/5 | 120000 | 3/7 | 6.0 |
| EXAMPLE 164 | (5-4) | — | 30000 | 3/7 | 6.0 |
| EXAMPLE 165 | (3-1)/ (3-5) = 8/2 | — | 60000 | 3/7 | 6.0 |
| EXAMPLE 166 | (3-1)/ (3-6) = 5/5 | — | 50000 | 3/7 | 6.0 |
| EXAMPLE 167 | (3-1)/ (3-5) = 8/2 | — | 60000 | 3/7 | 6.0 |
| EXAMPLE 168 | (3-1)/ (3-6) = 5/5 | — | 50000 | 3/7 | 6.0 |
| EXAMPLE 169 | (5-4) | — | 30000 | 3/7 | 6.0 |
| EXAMPLE 170 | (4-1) | 5/5 | 120000 | 3/7 | 6.0 |
| EXAMPLE 171 | (5-4) | — | 30000 | 3/7 | 6.0 |
| EXAMPLE 172 | (5-4) | — | 30000 | 3/7 | 6.0 |

TABLE 6

| | RESIN A | MASS RATIO A OF SILOXANE (PERCENT BY MASS) | RESIN B |
|---|---|---|---|
| COMPARATIVE EXAMPLE 101 | POLYCARBONATE RESIN A(127) | 8 | — |
| COMPARATIVE EXAMPLE 102 | POLYCARBONATE RESIN A(127) | 8 | POLYESTER RESIN C(4) |
| COMPARATIVE EXAMPLE 103 | POLYCARBONATE RESIN A(127) | 8 | POLYCARBONATE RESIN D(5) |
| COMPARATIVE EXAMPLE 104 | POLYCARBONATE RESIN A(128) | 50 | — |
| COMPARATIVE EXAMPLE 105 | POLYCARBONATE RESIN A(128) | 50 | POLYESTER RESIN C(4) |
| COMPARATIVE EXAMPLE 106 | POLYCARBONATE RESIN A(129) | 30 | POLYESTER RESIN C(4) |
| COMPARATIVE EXAMPLE 107 | POLYCARBONATE RESIN A(129) | 30 | POLYCARBONATE RESIN D(5) |
| COMPARATIVE EXAMPLE 108 | POLYCARBONATE RESIN A(130) | 25 | POLYESTER RESIN C(4) |
| COMPARATIVE EXAMPLE 109 | POLYCARBONATE RESIN A(131) | 30 | POLYESTER RESIN C(4) |
| COMPARATIVE EXAMPLE 110 | POLYCARBONATE RESIN A(131) | 30 | POLYCARBONATE RESIN D(4) |
| COMPARATIVE EXAMPLE 111 | POLYCARBONATE RESIN A(132) | 20 | POLYESTER RESIN C(4) |
| COMPARATIVE EXAMPLE 112 | POLYCARBONATE RESIN A(33) | 8 | POLYESTER RESIN C(4) |
| COMPARATIVE EXAMPLE 113 | POLYCARBONATE RESIN A(34) | 30 | POLYESTER RESIN C(4) |
| COMPARATIVE EXAMPLE 116 | POLYCARBONATE RESIN A(122) | 30 | — |
| COMPARATIVE EXAMPLE 117 | POLYCARBONATE RESIN A(128) | 50 | POLYCARBONATE RESIN D(5) |
| COMPARATIVE EXAMPLE 118 | POLYCARBONATE RESIN A(130) | 25 | POLYCARBONATE RESIN D(5) |
| COMPARATIVE EXAMPLE 119 | POLYCARBONATE RESIN A(132) | 20 | POLYCARBONATE RESIN D(5) |

TABLE 6-continued

| | REPEATING STRUCTURAL UNIT OF RESIN B | m-PHENYLENE/ p-PHENYLENE | WEIGHT AVERAGE MOLECULAR WEIGHT OF RESIN B (Mw) | MIX RATIO OF RESIN A TO RESIN B (A/B) | MASS RATIO B OF SILOXANE (PERCENT BY MASS) |
|---|---|---|---|---|---|
| COMPARATIVE EXAMPLE 101 | — | — | — | — | 8.0 |
| COMPARATIVE EXAMPLE 102 | (4-3) | 5/5 | 120000 | 1/9 | 0.8 |
| COMPARATIVE EXAMPLE 103 | (5-1) | — | 20000 | 3/7 | 2.4 |
| COMPARATIVE EXAMPLE 104 | — | — | — | — | 50.0 |
| COMPARATIVE EXAMPLE 105 | (4-3) | 5/5 | 120000 | 3/7 | 15.0 |
| COMPARATIVE EXAMPLE 106 | (4-3) | 5/5 | 120000 | 3/7 | 9.0 |
| COMPARATIVE EXAMPLE 107 | (5-1) | — | 60000 | 3/7 | 9.0 |
| COMPARATIVE EXAMPLE 108 | (4-3) | 5/5 | 120000 | 3/7 | 7.5 |
| COMPARATIVE EXAMPLE 109 | (4-3) | 5/5 | 120000 | 3/7 | 9.0 |
| COMPARATIVE EXAMPLE 110 | (5-3) | — | 50000 | 3/7 | 9.0 |
| COMPARATIVE EXAMPLE 111 | (4-3) | 5/5 | 120000 | 3/7 | 10.0 |
| COMPARATIVE EXAMPLE 112 | (4-3) | 5/5 | 120000 | 2/8 | 1.6 |
| COMPARATIVE EXAMPLE 113 | (4-3) | 5/5 | 120000 | 3/7 | 9.0 |
| COMPARATIVE EXAMPLE 116 | — | — | — | — | 30.0 |
| COMPARATIVE EXAMPLE 117 | (5-1) | — | 60000 | 3/7 | 15.0 |
| COMPARATIVE EXAMPLE 118 | (5-1) | — | 60000 | 3/7 | 7.5 |
| COMPARATIVE EXAMPLE 119 | (5-1) | — | 60000 | 3/7 | 10.0 |

The "resin A" in Tables 3, 4, 5, and 6 indicates a resin having a siloxane moiety, and in particular, the "resin A" in Tables 3 and 5 indicates the polycarbonate resin A used in the present invention.

The "mass ratio A (percent by mass) of siloxane" in Tables 3, 4, 5, and 6 indicates the content (percent by mass) of the siloxane moiety in the "resin A" to the total mass thereof.

The "resin B" in Tables 3, 4, 5, and 6 indicates at least one resin other than the "resin A" (the polyester resin C and/or the polycarbonate resin D).

The "mass ratio B (percent by mass) of siloxane" in Tables 3, 4, 5, and 6 indicates the content (percent by mass) of the siloxane moiety in the "resin A" to the total mass of the "resin A" and the "resin B".

TABLE 7

| | POTENTIAL VARIATION (V) | REL-ATIVE VALUE OF INITIAL TORQUE | REL-ATIVE VALUE OF TORQUE AFTER USE OF 2,000 SHEETS | NUMBER AVERAGE PARTICLE DIAMETER (nm) |
|---|---|---|---|---|
| EXAMPLE 1 | 5 | 0.63 | 0.66 | 200 |
| EXAMPLE 2 | 5 | 0.65 | 0.68 | 260 |
| EXAMPLE 3 | 5 | 0.64 | 0.68 | 150 |
| EXAMPLE 4 | 10 | 0.71 | 0.75 | 200 |

TABLE 7-continued

| | POTENTIAL VARIATION (V) | REL-ATIVE VALUE OF INITIAL TORQUE | REL-ATIVE VALUE OF TORQUE AFTER USE OF 2,000 SHEETS | NUMBER AVERAGE PARTICLE DIAMETER (nm) |
|---|---|---|---|---|
| EXAMPLE 5 | 11 | 0.77 | 0.81 | 250 |
| EXAMPLE 6 | 12 | 0.72 | 0.75 | 170 |
| EXAMPLE 7 | 10 | 0.82 | 0.77 | 100 |
| EXAMPLE 8 | 5 | 0.88 | 0.90 | 170 |
| EXAMPLE 9 | 10 | 0.77 | 0.78 | 300 |
| EXAMPLE 10 | 13 | 0.63 | 0.63 | 420 |
| EXAMPLE 11 | 12 | 0.68 | 0.69 | 200 |
| EXAMPLE 12 | 25 | 0.66 | 0.65 | 520 |
| EXAMPLE 13 | 10 | 0.71 | 0.69 | 220 |
| EXAMPLE 14 | 16 | 0.68 | 0.72 | 280 |
| EXAMPLE 15 | 18 | 0.65 | 0.68 | 270 |
| EXAMPLE 16 | 17 | 0.61 | 0.66 | 480 |
| EXAMPLE 17 | 7 | 0.63 | 0.67 | 380 |
| EXAMPLE 18 | 6 | 0.63 | 0.70 | 260 |
| EXAMPLE 19 | 18 | 0.69 | 0.68 | 350 |
| EXAMPLE 20 | 5 | 0.63 | 0.66 | 230 |
| EXAMPLE 21 | 5 | 0.65 | 0.69 | 180 |
| EXAMPLE 22 | 8 | 0.71 | 0.72 | 260 |
| EXAMPLE 23 | 18 | 0.88 | 0.89 | 120 |
| EXAMPLE 24 | 8 | 0.61 | 0.64 | 170 |
| EXAMPLE 25 | 8 | 0.72 | 0.69 | 180 |
| EXAMPLE 26 | 13 | 0.65 | 0.66 | 350 |

TABLE 7-continued

| | POTENTIAL VARIATION (V) | RELATIVE VALUE OF INITIAL TORQUE | RELATIVE VALUE OF TORQUE AFTER USE OF 2,000 SHEETS | NUMBER AVERAGE PARTICLE DIAMETER (nm) |
|---|---|---|---|---|
| EXAMPLE 27 | 10 | 0.71 | 0.69 | 200 |
| EXAMPLE 28 | 15 | 0.68 | 0.71 | 300 |
| EXAMPLE 29 | 10 | 0.64 | 0.72 | 200 |
| EXAMPLE 30 | 5 | 0.80 | 0.86 | 80 |
| EXAMPLE 31 | 9 | 0.65 | 0.70 | 310 |
| EXAMPLE 32 | 20 | 0.69 | 0.65 | 180 |
| EXAMPLE 33 | 15 | 0.66 | 0.68 | 220 |
| EXAMPLE 34 | 10 | 0.83 | 0.86 | 300 |
| EXAMPLE 35 | 20 | 0.69 | 0.74 | 300 |
| EXAMPLE 36 | 9 | 0.68 | 0.72 | 280 |
| EXAMPLE 37 | 20 | 0.77 | 0.80 | 400 |
| EXAMPLE 38 | 28 | 0.73 | 0.78 | 550 |
| EXAMPLE 39 | 28 | 0.73 | 0.75 | 580 |
| EXAMPLE 40 | 23 | 0.75 | 0.80 | 410 |
| EXAMPLE 41 | 29 | 0.73 | 0.77 | 600 |
| EXAMPLE 42 | 26 | 0.73 | 0.77 | 390 |
| EXAMPLE 43 | 31 | 0.70 | 0.75 | 580 |
| EXAMPLE 44 | 27 | 0.80 | 0.85 | 280 |
| EXAMPLE 45 | 27 | 0.76 | 0.78 | 590 |
| EXAMPLE 46 | 29 | 0.75 | 0.80 | 440 |
| EXAMPLE 47 | 27 | 0.78 | 0.79 | 460 |
| EXAMPLE 48 | 26 | 0.80 | 0.79 | 510 |
| EXAMPLE 49 | 30 | 0.81 | 0.83 | 430 |
| EXAMPLE 50 | 11 | 0.71 | 0.68 | 260 |
| EXAMPLE 51 | 28 | 0.68 | 0.73 | 500 |
| EXAMPLE 52 | 9 | 0.74 | 0.71 | 220 |
| EXAMPLE 53 | 30 | 0.74 | 0.78 | 450 |
| EXAMPLE 54 | 15 | 0.68 | 0.72 | 300 |
| EXAMPLE 55 | 35 | 0.66 | 0.75 | 520 |
| EXAMPLE 56 | 8 | 0.61 | 0.68 | 320 |
| EXAMPLE 57 | 4 | 0.72 | 0.75 | 150 |
| EXAMPLE 58 | 14 | 0.61 | 0.65 | 340 |
| EXAMPLE 59 | 7 | 0.62 | 0.69 | 330 |
| EXAMPLE 60 | 3 | 0.72 | 0.77 | 170 |
| EXAMPLE 61 | 11 | 0.61 | 0.66 | 350 |
| EXAMPLE 62 | 26 | 0.71 | 0.79 | 380 |
| EXAMPLE 63 | 25 | 0.7 | 0.81 | 420 |
| EXAMPLE 64 | 28 | 0.73 | 0.82 | 450 |
| EXAMPLE 65 | 11 | 0.62 | 0.7 | 350 |
| EXAMPLE 66 | 10 | 0.65 | 0.71 | 320 |
| EXAMPLE 67 | 12 | 0.65 | 0.71 | 360 |
| EXAMPLE 68 | 13 | 0.63 | 0.68 | 330 |
| EXAMPLE 69 | 7 | 0.66 | 0.72 | 330 |
| EXAMPLE 70 | 6 | 0.65 | 0.67 | 280 |
| EXAMPLE 71 | 21 | 0.63 | 0.75 | 350 |
| EXAMPLE 72 | 25 | 0.66 | 0.77 | 360 |
| COMPARATIVE EXAMPLE 1 | 15 | 0.95 | 0.98 | — |
| COMPARATIVE EXAMPLE 2 | 5 | 0.98 | 0.97 | — |
| COMPARATIVE EXAMPLE 3 | 35 | 0.95 | 0.98 | — |
| COMPARATIVE EXAMPLE 4 | 170 | 0.60 | 0.65 | — |
| COMPARATIVE EXAMPLE 5 | 100 | 0.70 | 0.78 | 900 |
| COMPARATIVE EXAMPLE 6 | 66 | 0.75 | 0.96 | — |
| COMPARATIVE EXAMPLE 7 | 88 | 0.82 | 0.97 | — |
| COMPARATIVE EXAMPLE 8 | 77 | 0.83 | 0.87 | 1200 (NON-UNIFORM) |
| COMPARATIVE EXAMPLE 9 | 95 | 0.77 | 0.93 | — |
| COMPARATIVE EXAMPLE 10 | 120 | 0.75 | 0.97 | — |
| COMPARATIVE EXAMPLE 11 | 5 | 0.85 | 0.91 | 50 |
| COMPARATIVE EXAMPLE 12 | 8 | 0.72 | 0.98 | — |

TABLE 7-continued

| | POTENTIAL VARIATION (V) | RELATIVE VALUE OF INITIAL TORQUE | RELATIVE VALUE OF TORQUE AFTER USE OF 2,000 SHEETS | NUMBER AVERAGE PARTICLE DIAMETER (nm) |
|---|---|---|---|---|
| COMPARATIVE EXAMPLE 13 | 105 | 0.68 | 0.98 | — |
| COMPARATIVE EXAMPLE 14 | 95 | 0.76 | 0.94 | — |
| COMPARATIVE EXAMPLE 15 | 150 | 0.88 | 0.90 | 600 |
| COMPARATIVE EXAMPLE 16 | 71 | 0.72 | 0.96 | — |
| COMPARATIVE EXAMPLE 17 | 92 | 0.68 | 0.80 | 1100 |
| COMPARATIVE EXAMPLE 18 | 81 | 0.81 | 0.90 | 1600 (NON-UNIFORM) |
| COMPARATIVE EXAMPLE 19 | 10 | 0.84 | 0.92 | 50 |

TABLE 8

| | POTENTIAL VARIATION (V) | RELATIVE VALUE OF INITIAL TORQUE | RELATIVE VALUE OF TORQUE AFTER USE OF 2,000 SHEETS | NUMBER AVERAGE PARTICLE DIAMETER (nm) |
|---|---|---|---|---|
| EXAMPLE 101 | 6 | 0.65 | 0.68 | 230 |
| EXAMPLE 102 | 8 | 0.63 | 0.66 | 280 |
| EXAMPLE 103 | 5 | 0.69 | 0.73 | 140 |
| EXAMPLE 104 | 8 | 0.66 | 0.7 | 180 |
| EXAMPLE 105 | 10 | 0.8 | 0.84 | 270 |
| EXAMPLE 106 | 9 | 0.69 | 0.72 | 180 |
| EXAMPLE 107 | 7 | 0.84 | 0.79 | 120 |
| EXAMPLE 108 | 5 | 0.86 | 0.88 | 160 |
| EXAMPLE 109 | 12 | 0.82 | 0.83 | 280 |
| EXAMPLE 110 | 14 | 0.58 | 0.58 | 440 |
| EXAMPLE 111 | 13 | 0.71 | 0.72 | 210 |
| EXAMPLE 112 | 25 | 0.63 | 0.62 | 510 |
| EXAMPLE 113 | 14 | 0.73 | 0.71 | 210 |
| EXAMPLE 114 | 16 | 0.66 | 0.7 | 260 |
| EXAMPLE 115 | 13 | 0.7 | 0.73 | 290 |
| EXAMPLE 116 | 17 | 0.56 | 0.61 | 490 |
| EXAMPLE 117 | 9 | 0.66 | 0.7 | 400 |
| EXAMPLE 118 | 6 | 0.6 | 0.67 | 250 |
| EXAMPLE 119 | 15 | 0.71 | 0.7 | 330 |
| EXAMPLE 120 | 8 | 0.61 | 0.64 | 250 |
| EXAMPLE 121 | 4 | 0.7 | 0.74 | 190 |
| EXAMPLE 122 | 8 | 0.66 | 0.67 | 280 |
| EXAMPLE 123 | 18 | 0.88 | 0.89 | 110 |
| EXAMPLE 124 | 11 | 0.58 | 0.61 | 150 |
| EXAMPLE 125 | 8 | 0.74 | 0.71 | 200 |
| EXAMPLE 126 | 13 | 0.63 | 0.64 | 360 |
| EXAMPLE 127 | 9 | 0.76 | 0.74 | 220 |
| EXAMPLE 128 | 10 | 0.63 | 0.66 | 290 |
| EXAMPLE 129 | 12 | 0.67 | 0.75 | 180 |
| EXAMPLE 130 | 6 | 0.77 | 0.83 | 100 |
| EXAMPLE 131 | 9 | 0.67 | 0.72 | 320 |
| EXAMPLE 132 | 18 | 0.67 | 0.63 | 200 |
| EXAMPLE 133 | 11 | 0.71 | 0.73 | 210 |
| EXAMPLE 134 | 9 | 0.78 | 0.81 | 280 |
| EXAMPLE 135 | 13 | 0.72 | 0.77 | 320 |
| EXAMPLE 136 | 9 | 0.65 | 0.69 | 290 |
| EXAMPLE 137 | 20 | 0.79 | 0.82 | 420 |
| EXAMPLE 138 | 26 | 0.71 | 0.76 | 520 |
| EXAMPLE 139 | 28 | 0.78 | 0.8 | 530 |
| EXAMPLE 140 | 22 | 0.7 | 0.75 | 430 |

TABLE 8-continued

| | POTENTIAL VARIATION (V) | RELATIVE VALUE OF INITIAL TORQUE | RELATIVE VALUE OF TORQUE AFTER USE OF 2,000 SHEETS | NUMBER AVERAGE PARTICLE DIAMETER (nm) |
|---|---|---|---|---|
| EXAMPLE 141 | 29 | 0.76 | 0.8 | 590 |
| EXAMPLE 142 | 22 | 0.7 | 0.74 | 410 |
| EXAMPLE 143 | 29 | 0.72 | 0.77 | 550 |
| EXAMPLE 144 | 23 | 0.78 | 0.83 | 260 |
| EXAMPLE 145 | 27 | 0.81 | 0.83 | 580 |
| EXAMPLE 146 | 26 | 0.7 | 0.75 | 450 |
| EXAMPLE 147 | 24 | 0.81 | 0.82 | 480 |
| EXAMPLE 148 | 23 | 0.77 | 0.76 | 500 |
| EXAMPLE 149 | 27 | 0.83 | 0.85 | 410 |
| EXAMPLE 150 | 19 | 0.69 | 0.66 | 380 |
| EXAMPLE 151 | 28 | 0.73 | 0.78 | 470 |
| EXAMPLE 152 | 18 | 0.69 | 0.66 | 340 |
| EXAMPLE 153 | 29 | 0.77 | 0.81 | 440 |
| EXAMPLE 154 | 16 | 0.65 | 0.69 | 280 |
| EXAMPLE 155 | 27 | 0.68 | 0.77 | 460 |
| EXAMPLE 156 | 9 | 0.62 | 0.69 | 300 |
| EXAMPLE 157 | 6 | 0.71 | 0.77 | 180 |
| EXAMPLE 158 | 15 | 0.62 | 0.71 | 330 |
| EXAMPLE 159 | 6 | 0.63 | 0.76 | 320 |
| EXAMPLE 160 | 5 | 0.73 | 0.75 | 190 |
| EXAMPLE 161 | 13 | 0.65 | 0.68 | 360 |
| EXAMPLE 162 | 24 | 0.73 | 0.79 | 360 |
| EXAMPLE 163 | 27 | 0.73 | 0.81 | 440 |
| EXAMPLE 164 | 29 | 0.71 | 0.82 | 450 |
| EXAMPLE 165 | 13 | 0.65 | 0.72 | 360 |
| EXAMPLE 166 | 11 | 0.66 | 0.69 | 330 |
| EXAMPLE 167 | 13 | 0.68 | 0.72 | 350 |
| EXAMPLE 168 | 15 | 0.64 | 0.68 | 320 |
| EXAMPLE 169 | 7 | 0.65 | 0.74 | 350 |
| EXAMPLE 170 | 8 | 0.64 | 0.69 | 290 |
| EXAMPLE 171 | 20 | 0.62 | 0.77 | 340 |
| EXAMPLE 172 | 27 | 0.68 | 0.78 | 360 |
| COMPARATIVE EXAMPLE 101 | 15 | 0.98 | 0.99 | — |
| COMPARATIVE EXAMPLE 102 | 5 | 0.95 | 0.94 | — |
| COMPARATIVE EXAMPLE 103 | 35 | 0.97 | 0.98 | — |
| COMPARATIVE EXAMPLE 104 | 170 | 0.58 | 0.63 | — |
| COMPARATIVE EXAMPLE 105 | 100 | 0.75 | 0.83 | 800 |
| COMPARATIVE EXAMPLE 106 | 66 | 0.7 | 0.91 | — |
| COMPARATIVE EXAMPLE 107 | 88 | 0.85 | 0.98 | — |
| COMPARATIVE EXAMPLE 108 | 77 | 0.8 | 0.84 | 1300 (NON-UNIFORM) |
| COMPARATIVE EXAMPLE 109 | 95 | 0.79 | 0.95 | — |
| COMPARATIVE EXAMPLE 110 | 120 | 0.73 | 0.95 | — |
| COMPARATIVE EXAMPLE 111 | 5 | 0.85 | 0.91 | 50 |
| COMPARATIVE EXAMPLE 112 | 8 | 0.72 | 0.98 | — |
| COMPARATIVE EXAMPLE 113 | 105 | 0.68 | 0.98 | — |
| COMPARATIVE EXAMPLE 116 | 71 | 0.7 | 0.94 | — |
| COMPARATIVE EXAMPLE 117 | 92 | 0.73 | 0.85 | 1000 |
| COMPARATIVE EXAMPLE 118 | 81 | 0.76 | 0.85 | 1500 (NON-UNIFORM) |
| COMPARATIVE EXAMPLE 119 | 10 | 0.84 | 0.92 | 50 |

By comparison between Examples and Comparative Examples 1 and 101, it is found that when the content of the siloxane moiety in the polycarbonate resin A to the total mass thereof in the charge transport layer is decreased, a sufficient effect of reducing contact stress cannot be obtained. This is shown by the results in which the relative value of initial torque and that of torque after a repeated use of 2,000 sheets according to this evaluation method are not sufficiently small.

By comparison between Examples and Comparative Examples 2, 3, 102, and 103, it is found that when the content of the siloxane moiety in the polycarbonate resin A to the total mass thereof in the charge transport layer is decreased, even if the polycarbonate resin A is used together with the polyester resin C and/or the polycarbonate resin D, the matrix-domain structure is not formed, and a sufficient effect of reducing contact stress cannot be obtained.

By comparison between Examples and Comparative Examples 4 and 104, it is found that when the content of the siloxane moiety in the polycarbonate resin A to the total mass thereof in the charge transport layer is increased, the compatibility with the charge transport material is degraded, the charge transport material is agglomerated in the polycarbonate resin A, and as a result, the potential variation occurs.

By comparison between Examples and Comparative Examples 5, 17, 105, and 117, it is found that even if the content of the siloxane moiety in the polycarbonate resin A to the total mass thereof is increased, when the polycarbonate resin A is used together with the polyester resin C and/or the polycarbonate resin D, the matrix-domain structure is formed, and the effect of reducing contact stress can be continuously obtained. However, the potential variation is increased when the content of the siloxane moiety is increased. Since the agglomerate of the charge transport material is confirmed in the domain by observation using a microscope, it is found that the content of the siloxane moiety to the total mass of the polycarbonate resin A is important in terms of a reduction effect of the potential variation.

By comparison between Examples and Comparative Examples 6, 7, 106, and 117, it is found that when the content of the repeating structural unit represented by the above formula (2) in the polycarbonate resin A is decreased, even if it the polycarbonate resin A is used together with the polyester resin C and/or the polycarbonate resin D, the matrix-domain structure is not formed, a sufficient effect of reducing contact stress cannot be obtained, and the potential variation is also increased. Accordingly, it is found that in terms of the formation of the matrix-domain structure, the content of the repeating structural unit represented by the above formula (2) in the polycarbonate resin A is important.

By comparison between Examples and Comparative Examples 8, 18, 108, and 118, it is found that even if the content of the repeating structural unit represented by the above formula (2) in the polycarbonate resin A is increased, when the polycarbonate resin A is used together with the polyester resin C and/or the polycarbonate resin D, the matrix-domain structure is formed. However, it is found that when the content of the repeating structural unit represented by the above formula (2) is high, the domains become large and non-uniform, and a continuous effect of reducing contact stress is not obtained, and the potential variation is also increased. Accordingly, it is found that when the content of the repeating structural unit represented by the above formula (2) is increased, the charge transport material is liable to be incorporated in the domains, and as a result, the domains become large and non-uniform.

By comparison between Examples and Comparative Examples 9, 10, 109, and 110, it is found that when the repeating structural unit represented by the above formula (2) is removed from the polycarbonate resin A, even if the polycarbonate resin A is used together with the polyester resin C and/or the polycarbonate resin D, the matrix-domain structure is not formed, a sufficient effect of reducing contact stress cannot be obtained, and the potential variation is also increased.

By comparison between Examples and Comparative Examples 11, 19, 111, and 119, it is found that when the average repeat number of the siloxane moiety in the polycarbonate resin A in the charge transport layer is decreased, even if the polycarbonate resin A is used together with the polyester resin C and/or the polycarbonate resin D, a sufficient effect of reducing contact stress cannot be obtained. Accordingly, it is found that the degree of the effect of reducing contact stress is dependent on the length of the main chain of the siloxane moiety. In addition, it is found that when the polycarbonate resin A is used, even if the average repeat number of the siloxane moiety is 10, the above effect can be obtained. Accordingly, it is found that the degree of the above effect is dependent on the structure of the repeating structural unit of the polycarbonate resin A.

By comparison between Examples and Comparative Examples 12 and 112, it is found that when a polycarbonate resin having a siloxane moiety only at its terminal is used instead of the polycarbonate resin A, because of the structure of the resin, the content of the siloxane moiety thereof is decreased to the polycarbonate resin containing a siloxane moiety in the charge transport layer, and as a result, a continuous effect of reducing contact stress cannot be obtained. In addition, when the polycarbonate resin having a siloxane moiety only at its terminal is used, unlike the case in which the polycarbonate resin A is used, the matrix-domain structure is not formed. Accordingly, in order to obtain the effect of reducing contact stress and to form the matrix-domain structure, it is found that the arrangement of the siloxane moiety in the polycarbonate resin is important.

By comparison between Examples and Comparative Examples 13 and 113, it is found that when a polycarbonate resin having a siloxane moiety in its main chain and the polyester resin C having no siloxane moiety are used together, the effect of reducing contact stress does not continue. The reason for this is that in the structure in which the siloxane moiety is present in the main chain, and two terminals thereof are bonded with carbonate bonds, the degree of freedom of the siloxane moiety is lost, and as a result, the matrix-domain structure is not likely to be formed.

By comparison between Examples and Comparative Example 14, it is found that when a polyester resin having a siloxane moiety only at its terminal is used instead of the polycarbonate resin A, the potential variation is increased, and the continuation of the effect of reducing contact stress becomes insufficient. Accordingly, in terms of the formation of the matrix-domain structure, it is found that besides the arrangement of the siloxane moiety, the structure of a copolymer of the polycarbonate resin A is also important.

By comparison between Examples and Comparative Example 15, it is found that even when methylphenylpolysiloxane is used instead of the polycarbonate resin A, the matrix-domain structure is formed, and the effect of reducing contact stress can be continuously obtained. However, it is found that when methylphenylpolysiloxane is used, the potential variation is increased. It has been known that a silicone oil material, such as methylphenylpolysiloxane, having a siloxane moiety has an adverse influence on the potential, and the reason the potential variation is increased is believed that a silicone oil material migrates to the interface between the charge generation layer and the charge transport layer. Since having the structure in which a phenyl group is introduced into a silicone oil material, methylphenylpolysiloxane is suppressed from migrating to the vicinity of the interface between the charge generation layer and the charge transport layer; however, it is believed that this suppression is not sufficient, and as a result, the potential variation occurs. On the other hand, since containing a specific amount of the repeating structural unit (diphenyl ether structure) represented by the above formula (2) besides the siloxane moiety, the polycarbonate resin A is suppressed from migrating to the interface between the charge generation layer and the charge transport layer, and in addition, since the domains are formed, the potential variation is suppressed.

By comparison between Examples and Comparative Examples 16 and 116, it is found that even when the polycarbonate resin A is set within the range of the present invention, if the polyester resin C and/or the polycarbonate resin D is not used together therewith, the matrix-domain structure is not formed, a sufficient effect of reducing contact stress cannot be obtained, and the potential variation is also increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-279919, filed Dec. 9, 2009, No. 2009-279920 filed Dec. 9, 2009 and No. 2010-251153 filed Nov. 9, 2010, which are hereby incorporated by reference herein in their entirety.

The invention claimed is:

1. An electrophotographic photosensitive member comprising:

a conductive support;

a charge generation layer provided on the conductive support; and a charge transport layer which is provided on the charge generation layer, and wherein the charge transport layer is a surface layer, wherein the charge transport layer contains:

the charge transport material;

a polycarbonate resin A having a repeating structural unit represented by the following formula (1) or (101), a repeating structural unit represented by the following formula (2), and a repeating structural unit represented by the following formula (3); and at least one of a polyester resin C having a repeating structural unit represented by the following structural unit (C) and a polycarbonate resin D having a repeating structural unit represented by the following formula (D);

the content of a siloxane moiety in the polycarbonate resin A is 10 to 40 percent by mass to the total mass of the polycarbonate resin A, the content of the repeating structural unit represented by the following formula (2) in the polycarbonate resin A is 5 to 50 percent by mass to the total mass of the polycarbonate resin A, and the charge transport layer has a matrix-domain structure including a matrix formed from the charge transport material and at least one of the polyester resin C and the polycarbonate resin D and domains formed in the matrix from the polycarbonate resin A,

[Chem. 1]

(1)

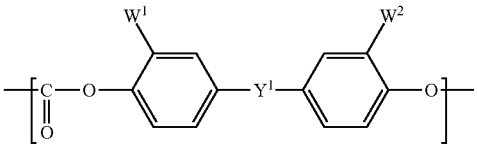

where in the formula (1), $Y^1$ represents a single bond or a substituted or an unsubstituted alkylene group, and $W^1$ and $W^2$ independently represent a monovalent group represented by the following formula (a) or (b):

[Chem. 2]

(a)

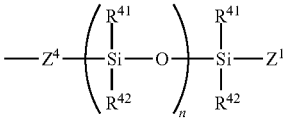

(b)

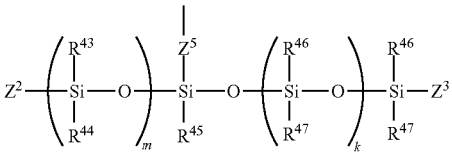

where in the formulas (a) and (b), $Z^1$ to $Z^3$ independently represent a substituted or an unsubstituted alkyl group having 1 to 4 carbon atoms, $Z^4$ and $Z^5$ independently represent a substituted or an unsubstituted alkylene group having 1 to 4 carbon atoms, $R^{41}$ to $R^{47}$ independently represent a substituted or an unsubstituted alkyl group or a substituted or an unsubstituted aryl group, and n, m, and k independently represent the average repeat number of the structure in the parentheses, n is 10 to 150, and m+k is 10 to 150,

[Chem. 3]

(101)

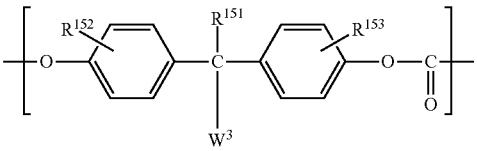

where in the formula (101), $R^{151}$ to $R^{153}$ independently represent a hydrogen atom, a substituted or an unsubstituted alkyl group, or a substituted or an unsubstituted aryl group, and $W^3$ represents a monovalent group represented by the following formula (e) or (f):

[Chem. 4]

(e)

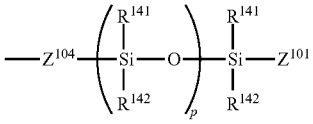

(f)

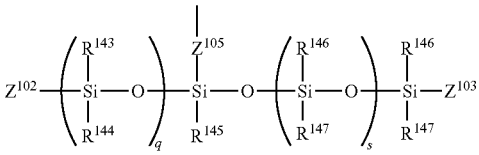

where in the formulas (e) and (f), $Z^{101}$ to $Z^{103}$ independently represent a substituted or an unsubstituted alkyl group having 1 to 4 carbon atoms, $Z^{104}$ and $Z^{105}$ independently represent a substituted or an unsubstituted alkylene group having 1 to 20 carbon atoms, $R^{141}$ to $R^{147}$ independently represent a substituted or an unsubstituted alkyl group or a substituted or an unsubstituted aryl group, and p, q, and s independently represent the average repeat number of the structure in the parentheses, p is 10 to 150, and q+s is 10 to 150,

[Chem. 5]

(2)

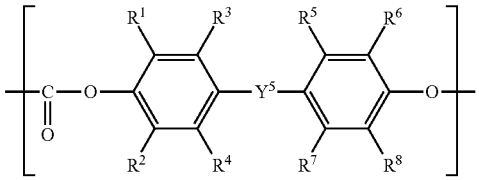

where in the formula (2), $R^1$ to $R^8$ independently represent a hydrogen atom or a substituted or an unsubstituted alkyl group, and $Y^5$ represents an oxygen atom or a sulfur atom,

[Chem. 6]

(3)

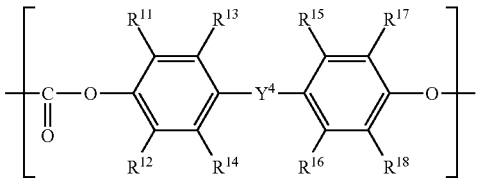

where in the formula (3), $R^{11}$ to $R^{18}$ independently represent a hydrogen atom or a substituted or an unsubstituted alkyl group, and $Y^4$ represents a single bond or a substituted or an unsubstituted alkylene group,

[Chem. 7]

(C)

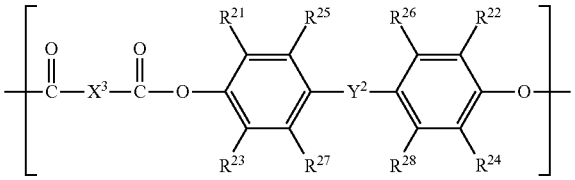

where in the formula (C), $R^{21}$ to $R^{28}$ independently represent a hydrogen atom or a substituted or an unsubstituted alkyl group, $X^3$ represents a substituted or an unsubstituted alkylene group, a substituted or an unsubstituted arylene group, a substituted or an unsubstituted biphenylene group, or a divalent group in which at least two phenylene groups are bonded to each other with an alkylene group or an oxygen atom interposed therebetween, and $Y^2$ represents a single bond or a substituted or an unsubstituted alkylene group,

[Chem. 8]

(D)

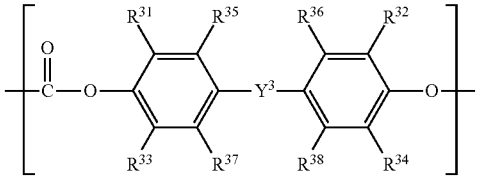

where in the formula (D), $R^{31}$ to $R^{38}$ independently represent a hydrogen atom, or a substituted or an unsubstituted alkyl group, and $Y^3$ represents a single bond, or a substituted or an unsubstituted alkylene group.

2. The electrophotographic photosensitive member according to claim 1, wherein the content of the siloxane moiety of the polycarbonate resin A in the charge transport layer is in a range of 2 to 20 percent by mass to the total mass of the polycarbonate resin A, the polyester resin C, and the polycarbonate resin D, each of which is in the charge transport layer.

3. The electrophotographic photosensitive member according to claim 1, wherein n in the formula (1) or (101) is in a range of 20 to 100.

4. A process cartridge comprising: the electrophotographic photosensitive member according to claim 1; and at least one unit selected from the group consisting of a charging unit, a developing unit, a transfer unit, and a cleaning unit, wherein the electrophotographic photosensitive member and the at least one unit are integrally supported and are detachably mountable to a main body of an electrophotographic apparatus.

5. An electrophotographic apparatus comprising: the electrophotographic photosensitive member according to claim 1, a charging unit, an exposure unit, a developing unit, and a transfer unit.

* * * * *